US012264373B2

(12) United States Patent
Ueda et al.

(10) Patent No.: US 12,264,373 B2
(45) Date of Patent: Apr. 1, 2025

(54) RAIL AND METHOD OF MANUFACTURING RAIL

(71) Applicant: NIPPON STEEL CORPORATION, Tokyo (JP)

(72) Inventors: Masaharu Ueda, Tokyo (JP); Jun Takahashi, Tokyo (JP); Teruhisa Miyazaki, Tokyo (JP); Takuya Tanahashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 1073 days.

(21) Appl. No.: 17/271,266

(22) PCT Filed: Aug. 21, 2019

(86) PCT No.: PCT/JP2019/032627
§ 371 (c)(1),
(2) Date: Feb. 25, 2021

(87) PCT Pub. No.: WO2020/054339
PCT Pub. Date: Mar. 19, 2020

(65) Prior Publication Data

US 2021/0395847 A1 Dec. 23, 2021

(30) Foreign Application Priority Data

Sep. 10, 2018 (JP) ..... 2018-168799

(51) Int. Cl.
*C21D 6/00* (2006.01)
*B21B 1/085* (2006.01)
(Continued)

(52) U.S. Cl.
CPC ..... *C21D 6/008* (2013.01); *B21B 1/085* (2013.01); *C21D 8/0226* (2013.01);
(Continued)

(58) Field of Classification Search
CPC ..... C21D 6/008
See application file for complete search history.

(56) References Cited

U.S. PATENT DOCUMENTS 5,762,723 A 6/1998 Ueda et al.
5,830,286 A 11/1998 Ueda et al.
(Continued)

FOREIGN PATENT DOCUMENTS

CN 107208217 A 9/2017
JP S63-23244 B2 5/1988
(Continued)

OTHER PUBLICATIONS

"Vickers hardness test-Test method", JIS Z 2244, 2009, pp. 394-497.

*Primary Examiner* — Christopher S Kessler
(74) *Attorney, Agent, or Firm* — Rabin & Berdo, P.C.

(57) ABSTRACT

According to one aspect of the present invention, what is provided is a rail including, by mass %: C: 0.75% to 1.20%; Si: 0.10% to 2.00%; Mn: 0.10% to 2.00%; Cr: 0.10% to 1.20%; V: 0.010% to 0.200%; N: 0.0030% to 0.0200%; P≤0.0250%; S≤0.0250%; Mo: 0% to 0.50%, Co: 0% to 1.00%; B: 0% to 0.0050%; Cu: 0% to 1.00%; Ni: 0% to 1.00%; Nb: 0% to 0.0500%; Ti: 0% to 0.0500%; Mg: 0% to 0.0200%; Ca: 0% to 0.0200%; REM: 0% to 0.0500%; Zr: 0% to 0.0200%; Al: 0% to 1.00%; and a remainder consisting of Fe and impurities, in which a structure ranging from an outer surface of a head portion as an origin to a depth of 25 mm includes 95% or greater of a pearlite structure by area ratio, the hardness of the structure is in a range of Hv 360 to 500, and in ferrite of the pearlite structure at a position at a depth of 25 mm from the outer surface of the head portion as the origin, the number density of a V nitride having a grain size of 0.5 to 4.0 nm and including Cr is in a range of $1.0\times10^{17}$ to $5.0\times10^{17}$ $cm^{-3}$.

4 Claims, 3 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/24*** | (2006.01) |
| ***C22C 38/34*** | (2006.01) |
| ***C22C 38/38*** | (2006.01) |
| ***E01B 5/02*** | (2006.01) |

(52) U.S. Cl.

CPC ..... *C22C 38/001* (2013.01); *C22C 38/02* (2013.01); *C22C 38/24* (2013.01); *C22C 38/34* (2013.01); *C22C 38/38* (2013.01); *E01B 5/02* (2013.01)

(56) References Cited

U.S. PATENT DOCUMENTS

| | | | |
|---|---|---|---|
| 2010/0116381 | A1 | 5/2010 | Honjo et al. |
| 2017/0369975 | A1 | 12/2017 | Ueda et al. |

FOREIGN PATENT DOCUMENTS

| | | | |
|---|---|---|---|
| JP | H08-144016 | A | 6/1996 |
| JP | 2002-226915 | A | 8/2002 |
| JP | 3445619 | B2 | 9/2003 |
| JP | 3513427 | B2 | 3/2004 |
| JP | 2009-108397 | A | 5/2009 |
| JP | 2010255046 | A | 11/2010 |
| JP | 2017206743 | A | 11/2017 |

RAIL AND METHOD OF MANUFACTURING RAIL

TECHNICAL FIELD OF THE INVENTION

The present invention relates to a high-strength rail which is used in cargo railways and has excellent wear resistance and internal fatigue damage resistance and a manufacturing method thereof.

Priority is claimed on Japanese Patent Application No. 2018-168799, filed on Sep. 10, 2018, the content of which is incorporated herein by reference.

RELATED ART

With economic development, natural resources such as coal have been newly developed. Specifically, mining of natural resources in regions with severe natural environments which were not developed yet has been promoted. Along with this, the orbital environment of cargo railways used to transport resources has become significantly severe. As a result, rails have been required to have better wear resistance than ever.

Further, in cargo railways, recently, railway transport has been further overcrowded. Therefore, there is a concern for fatigue damage occurring from the inside of a rail head portion (position at a depth of 20 to 30 mm from the outer surface of the head portion).

From this background, there has been a demand for development of high-strength rails with improved wear resistance and internal fatigue damage resistance.

In order to improve the wear resistance of rail steel, for example, high-strength rails described in Patent Documents 1 and 2 have been developed. These rails are mainly characterized in that in order to improve the wear resistance, the hardness of steel is increased by refining lamellar spacing in a pearlite structure using a heat treatment or the volume ratio of cementite in a lamellar structure of a pearlite structure is increased by increasing the amount of carbon in steel.

Specifically, Patent Document 1 discloses that a rail with excellent wear resistance can be provided by performing accelerated cooling on a rail head portion which is rolled or re-heated at a cooling rate of 1° C. to 4° C./sec from the austenitic temperature to a temperature in a range of 850° C. to 500° C.

In addition, Patent Document 2 discloses that a rail having excellent wear resistance can be provided by increasing the volume ratio of cementite in a lamellar structure of a pearlite structure using hyper-eutectoid steel (C: greater than 0.85% and 1.20% or less).

In the technique disclosed in Patent Documents 1 or 2, the wear resistance of a certain region can be improved by refining lamellar spacing in a pearlite structure to increase the hardness or by increasing the volume ratio of cementite in a lamellar structure of a pearlite structure.

However, in the high-strength rails disclosed in Patent Documents 1 and 2, occurrence of the internal fatigue damage cannot be suppressed.

In order to solve the above-described problems, for example, a high-strength rails are suggested as described in Patent Documents 3, 4, or 5. These rails are mainly characterized in that, in order to improve not only wear resistance but also internal fatigue damage resistance, pearlitic transformation is controlling by adding a small amount of an alloy or the internal hardness of a head portion is improved by controlling an alloy or adding a small amount of alloy to form a precipitate in a pearlite structure.

Specifically, Patent Document 3 discloses that the internal hardness of a head portion is improved by adding B to hyper-eutectoid steel (C: greater than 0.85% and 1.20% or less) to control the transformation temperature in a pearlite structure inside the head portion. Further, Patent Document 4 discloses that the internal hardness of a head portion is improved by adding V and N to hyper-eutectoid steel (C: greater than 0.85% and 1.20% or less) to precipitate a V carbonitride in a pearlite structure. Further, Patent Document 5 discloses that the internal hardness of a head portion is improved by using eutectoid steel (0.73% to 0.85% of C) as a base and controlling the Mn content and the Cr content.

In the technique disclosed in Patent Document 3, 4, or 5, the internal hardness of a head portion is improved by controlling the pearlitic transformation temperature in the head portion or by precipitation hardening of a pearlite structure such that the internal fatigue damage resistance of a certain region can be improved. However, with the high-strength rails disclosed in Patent Documents 3, 4, and 5, sufficient characteristics cannot be obtained during use in a severe orbital environment which has been required in recent years, and thus further improvement of the internal fatigue damage resistance has become an issue.

As described above, a high-strength rail which can be used in cargo railways in a severe orbital environment and has excellent wear resistance and internal fatigue damage resistance has not been provided.

PRIOR ART DOCUMENT

Patent Document

[Patent Document 1] Japanese Examined Patent Application, Second Publication No. S63-023244
[Patent Document 2] Japanese Unexamined Patent Application, First Publication No. H8-144016
[Patent Document 3] Japanese Patent No. 3445619
[Patent Document 4] Japanese Patent No. 3513427
[Patent Document 5] Japanese Unexamined Patent Application, First Publication No. 2009-108397

DISCLOSURE OF THE INVENTION

Problems to be Solved by the Invention

The present invention has been made in order to solve the above-described problems, and an object thereof is to provide a rail having excellent wear resistance and internal fatigue damage resistance.

Means for Solving the Problem (1) According to one aspect of the present invention, there is provided a rail including, by mass %; C: 0.75% to 1.20%; Si: 0.10% to 2.00%; Mn: 0.10% to 2.000%; Cr: 0.10% to 1.20%; V: 0.010% to 0.200%; N: 0.0030% to 0.0200%; P≤0.0250%; S≤0.0250%; Mo: 0% to 0.50%; Co: 0% to 1.00%; B: 0% to 0.0050%; Cu: 0% to 1.00%; Ni: 0% to 1.00%; Nb: 0% to 0.0500%; Ti: 0% to 0.0500%; Mg: 0% to 0.0200%; Ca: 0% to 0.0200%; REM: 0% to 0.0500%; Zr: 0% to 0.0200%; Al: 0% to 1.00%; and a remainder including Fe and impurities, in which a structure ranging from an outer surface of a head portion as an origin to a depth of 25 mm includes 95% or greater of a pearlite structure by area ratio, a hardness of the structure is in a range of Hv 360 to 500, and in ferrite of the pearlite structure at a position at a depth of 25 mm from the outer surface of the head portion as the origin, a number density of a V nitride having a grain size of 0.5 to 4.0 nm and including Cr is in a range of $1.0\times10^{17}$ to $5.0\times10^{17}$ $cm^{-3}$.

(2) In the rail according to (1), in the V nitride having the grain size of 0.5 to 4.0 nm and including Cr in the ferrite of the pearlite structure at a position at the depth of 25 mm from the outer surface of the head portion, when the number of V atoms is represented by VA and the number of Cr atoms is represented by CA, the average value of CA/VA may satisfy the following Expression 1, $$0.01 \leq CA/VA \leq 0.70 \quad \text{Expression 1.}$$

(3) The rail according to (1) or (2), may include, by mass %, one or more groups selected from the group consisting of: a group a: Mo: 0.01% to 0.50%; a group b: Co: 0.01% to 1.00%; a group c: B: 0.0001% to 0.00500%; a group d: one or two selected from Cu: 0.01% to 1.00% and Ni: 0.01% to 1.00%, a group e: one or two selected from Nb: 0.0010% to 0.0500% and Ti: 0.0030% to 0.0500%; a group f: one or two selected from Mg: 0.0005% to 0.0200%, Ca: 0.0005% to 0.0200%, and REM: 0.0005% to 0.0500%; a group g: Zr: 0.0001% to 0.0200%, and a group h: Al: 0.0100% to 1.00%.

(4) According to another aspect of the present invention, there is provided a method of manufacturing a rail, the method including: heating a bloom at a heating finish temperature of 1200° C. or higher and at a heating rate of 1 to 8° C./min in a range of 1000° C. to 1200° C., the bloom including, by mass %, C: 0.75% to 1.20%, Si: 0.10% to 2.00%, Mn: 0.10% to 2.00%, Cr: 0.10% to 1.20%, V: 0.010% to 0.200%, N: 0.0030% to 0.0200%, P≤0.0250%, S≤0.0250%, Mo: 0% to 0.50%, Co: 0% to 1.00%, B: 0% to 0.0050%, Cu: 0% to 1.00%, Ni: 0% to 1.00%, Nb: 0% to 0.0500%, Ti 0% to 0.0500%, Mg: 0% to 0.0200%, Ca: 0% to 0.0200%, REM: 0% to 0.0500%, Zr: 0% to 0.0200%, Al: 0% to 1.00%, and a remainder including Fe and impurities; hot-rolling the heated bloom under conditions of a finish rolling temperature of 850° C. to 1000° C. and a final rolling reduction of 2% to 20% to form a rail; performing accelerated cooling on the rail under conditions of a start temperature of the accelerated cooling of 750° C. or higher, the average cooling rate of the accelerated cooling of 2 to 30° C./sec, and an end temperature of the accelerated cooling of 580° C. to 660° C.; performing controlled cooling on the rail under conditions of a retention temperature of 580° C. to 660° C., a temperature holding time of 5 to 150 sec, and the fluctuation of a rail surface temperature of 60° C. or lower, and performing air cooling or accelerated cooling of the rail up to a normal temperature.

Effects of the Invention

According to the aspects of the present invention, the wear resistance and the internal fatigue damage resistance of the rail can be improved. In addition, when the rail is used in cargo railways, the service life of the rail can be significantly improved.

EMBODIMENTS OF THE INVENTION

Figure 1:
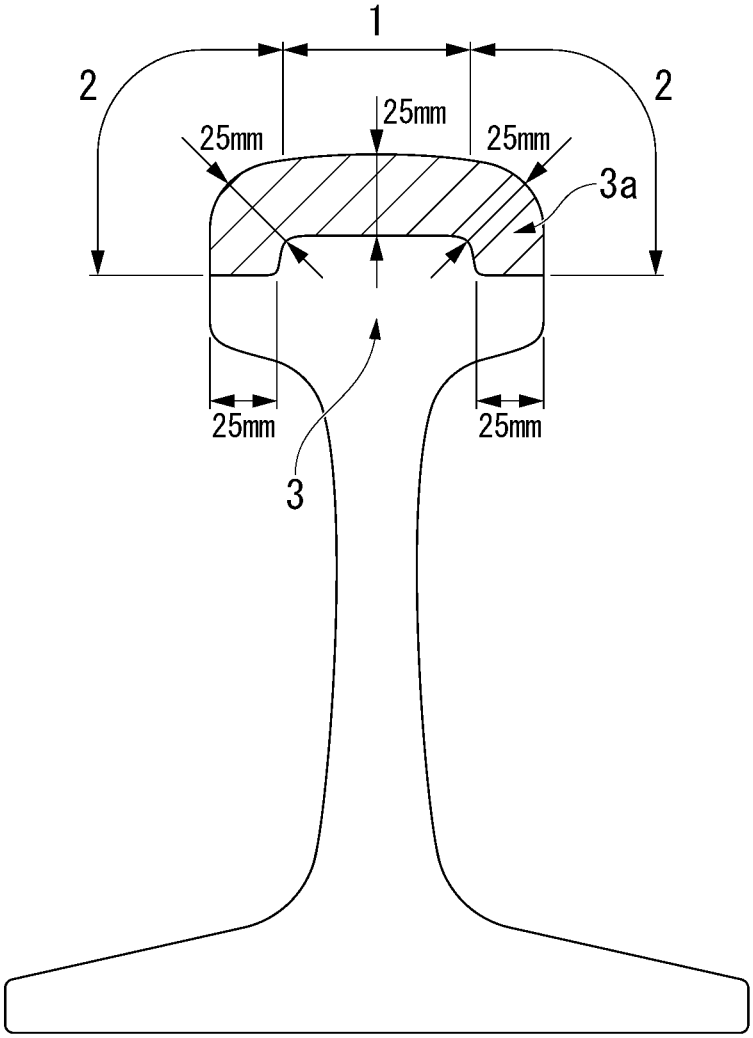
FIG. 1 is a diagram showing names at cross sectional surface positions of a head portion and a region where a pearlite structure is required in a rail according to an embodiment.

Hereinafter, a rail having excellent wear resistance and internal fatigue damage resistance according to an embodiment of the present invention (hereinafter, also referred to as the rail according to the embodiment) will be described in detail. Hereinafter, "mass %" in the composition is simply described as "%".

The rail according to the embodiment has the following characteristics.

(i) The rail has a predetermined chemical composition.

(ii) A structure ranging from an outer surface of a head portion as an origin to a depth of 25 mm includes 95% or greater of a pearlite structure by area ratio, and the hardness of the structure is in a range of Hv 360 to 500.

(iii) In ferrite of the pearlite structure at a position at a depth of 25 mm from the outer surface of the head portion as the origin, a number density of a V nitride having a grain size of 0.5 to 4.0 nm and including Cr is in a range of $1.0\times10^{17}$ to $5.0\times10^{17}$ $cm^{-3}$.

(iv) It is preferable that, in the V nitride having a grain size of 0.5 to 4.0 nm and including Cr in the ferrite of the pearlite structure at a position at a depth of 25 mm from the outer surface of the head portion, when the number of V atoms is represented by VA and the number of Cr atoms is represented by CA, the average value of CA/VA satisfies the following Expression 1 (the average value of CA/VA in the V nitride having a grain size of 0.5 to 4.0 nm and including Cr will also be simply referred to as "CA/VA").

$$0.01 \leq \text{average value of } CA/VA \leq 0.70 \quad \text{Expression 1.}$$

<Reason for Limiting Metallographic Structure and Range where Pearlite Structure is Required>

It is necessary that the rail according to the embodiment includes 95% or greater (area ratio) of a pearlite structure in a range from the outer surface of the head portion as an origin to a depth of at least 25 mm.

First, the reason for setting the area ratio of the pearlite structure to 95% or greater will be described.

In the rail head portion that comes into contact with wheels, it is most important to ensure wear resistance. The present inventors conducted an investigation on a relationship between a metallographic structure and wear resistance and found that a pearlite structure has the highest wear resistance. Further, in the pearlite structure, even when the amount of alloy elements is small, hardness (strength) can be easily obtained, and internal fatigue damage resistance is also excellent. Therefore, in order to improve the wear resistance and the internal fatigue damage resistance, the area ratio of the pearlite structure is limited to 95% or greater. When the area ratio of the pearlite structure is less than 95%, the wear resistance and the internal fatigue damage resistance are not sufficiently improved. In order to sufficiently ensure wear resistance, it is desirable that 96% or greater, 97% or greater, 98% or greater, or 99% or greater of the metallographic structure in the rail head portion is a pearlite structure. The area ratio of the pearlite structure in the rail head portion may be 100%.

Next, the reason for limiting the range where the metallographic structure (structure including pearlite) including 95% or greater of the pearlite structure by area ratio is required to be in a range from an outer surface of a head portion (surfaces of corner head portions and a head top portion) as the origin to a depth of at least 25 mm will be described.

When the range of the structure including the pearlite structure is less than 25 mm from the outer surface of the head portion as the origin, the range is not sufficient as the region for which the wear resistance or the internal fatigue damage resistance of the rail head portion is required in consideration of wear during use, and the wear resistance and the internal fatigue damage resistance cannot be sufficiently improved. As a result, the rail service life is difficult to sufficiently improve. Therefore, it is preferable that a range from the outer surface of the head portion as the origin to a depth of 30 mm is set to a structure including the pearlite structure in order to further improve the wear resistance and the internal fatigue damage resistance.

Here, FIG. 1 shows names at cross sectional surface positions of a head portion and a region where the structure including the pearlite structure is required in the rail according to the embodiment. First, a rail head portion indicates a portion positioned above a constricted portion at the center of the rail in the height direction in a cross sectional view of the rail as denoted by the reference numeral 3 of FIG. 1. Further, a rail head portion 3 includes a head top portion 1 and corner head portions 2 positioned at both ends of the head top portion 1. One head corner head portion 2 is a gauge corner (G. C.) portion mainly in contact with wheels. Further, an outer surface of the head portion indicates both of a surface of the head top portion 1 facing the upper side when the rail is upright and surfaces of the corner head portions 2 in the rail head portion 3. A positional relationship between the head top portion 1 and the corner head portions 2 is that the head top portion 1 is positioned substantially at the center of the rail head portion in the width direction and the corner head portions 2 are positioned on both sides of the head top portion 1.

The range from the surface of the corner head portions 2 and the head top portion 1 (outer surface of the head portion) as the origin to a depth of 25 mm will be referred to as a head surface portion (3*a*, hatched portion). As shown in FIG. 1, in order to improve the wear resistance and the internal fatigue damage resistance of the rail, it is necessary that a structure including a pearlite structure with a predetermined hardness (metallographic structure including 95% or greater of a pearlite structure by area ratio) is disposed in the head surface portion 3*a* from the surface of the corner head portions 2 and the head top portion 1 (outer surface of the head portion) as the origin to a depth of 25 mm.

Therefore, it is preferable that the structure including the pearlite structure is disposed in the head surface portion 3*a* where wheels and the rail are mainly in contact and the wear resistance and the internal fatigue damage resistance are required. In a portion other than the head surface portion where these characteristics are not required, the area ratio of the pearlite structure may or may not be 95% or greater.

Moreover, as long as the area ratio of the pearlite structure is 95% or greater, a pro-eutectoid ferrite structure, a pro-eutectoid cementite structure, a bainite structure, or a martensite structure other than the pearlite structure may be incorporated into the metallographic structure of the head surface portion 3*a* of the rail according to the embodiment in a small amount of less than 5% by area ratio. Even if these structures are incorporated into the metallographic structure, as long as the area ratio thereof is less than 5%, there is no significant adverse effect on the wear resistance of the surface of the head portion and the internal fatigue damage resistance of the inside of the head portion. In other words, in the metallographic structure of the rail head portion of the rail according to the embodiment, 95% or greater of the head surface portion by area ratio only has to be the pearlite structure, and in order to sufficiently improve the wear resistance or the internal fatigue damage resistance, it is preferable that 98% or greater of the metallographic structure in the head surface portion of the rail head portion is the pearlite structure. The area ratio of the pearlite structure may be 100%.

The area ratio of the pearlite structure in the range from the outer surface of the head portion as the origin to a depth of 25 mm can be acquired with the following method. That is, the area ratio of the pearlite structure can be determined by observing the metallographic structure in the visual field of a 200-fold optical microscope and determining the area of each metallographic structure. Further, 10 or more visual fields (10 sites) are used as the visual fields of the optical microscope, and the average value of the area ratios can be used as the area ratio of the observed portion.

A method of evaluating the metallographic structure is as follows.

[Evaluation Procedure and Method of Metallographic Structure]

Evaluation Procedure

- Collection of test piece for measurement: a sample was cut out from a transverse cross section of the rail head portion
- Pre-processing: 3% nital etching treatment was performed after polishing the sample with a diamond grit
- Observation of structure: optical microscope (200-fold)
- Visual fields: 10 or more visual fields from the outer surface of the head portion to a depth of 2 mm and 10 or more visual fields from the outer surface of the head portion to a depth of 25 mm Evaluation Method

- Determination of structure: a structure was determination based on textbooks of metallography (for example, "Introduction to Structures and Properties of metallic materials and Heat Treatment Utilizing Materials and Microstructure Control": The Japan Society for Heat Treatment); when a structure was unclear, the structure was determined by SEM observation
- Determination of ratio: the area of each structure was measured, an area ratio in each visual field was calculated, and the average value in all visual fields was set to a representative value of the portion In the rail according to the embodiment, when the average area ratio of the pearlite structure at two positions including a position at a depth of 2 mm from the outer surface of the head portion as the origin and a position a depth of 25 mm from the outer surface of the head portion as the origin is 95% or greater, it can be said that 95% or greater of the metallographic structure in a range from the outer surface of the head portion as the origin to a depth of at least 25 mm by area ratio is the pearlite structure.

<Reason for Limiting Hardness of Structure Including Pearlite Structure>

In the rail according to the embodiment, it is necessary to limit the hardness of the structure including the pearlite structure to be in a range of Hv 360 to 500. Next, the reason for limiting the hardness of the structure including the pearlite structure in the rail according to the embodiment to be in a range of Hv 360 to 500 will be described.

The hardness of the metallographic structure including the pearlite structure required for ensuring the wear resistance and the internal fatigue damage resistance of the rail was examined by the present inventors.

By performing rail rolling using steel (hyper-eutectoid steel) including components 0.90% of C, 0.50% of Si, 0.70% of Mn, 0.50% of Cr, 0.010% to 0.200% of V, 0.0150% of P, 0.0120% of S, and 0.0030% to 0.0200% of N, a relationship between the hardness of the rail head portion and the wear resistance and internal fatigue damage resistance was investigated. The rail rolling, heat treatment conditions, rolling fatigue test conditions are as follows.

[Actual Rail Rolling, Heat Treatment Test]

Steel Component

- 0.90% of C, 0.50% of Si, 0.70% of Mn, 0.50% of Cr, 0.010% to 0.200% of V, 0.0150% of P, 0.0120% of S, and 0.0030% to 0.0200% of N (remainder consisting of Fe and impurities)

Rail Shape

- 141 lbs (weight: 70 kg/m)

Rolling and Heat Treatment Conditions

- Finish rolling temperature (outer surface of head portion): 950° C.
- Heat treatment conditions: rolling→accelerated cooling
- Accelerated cooling conditions (outer surface of head portion): cooling from 800° C. to temperature range of 580° C. to 680° C. at cooling rate of 2 to 15° C./sec Accelerated cooling was performed by spraying a cooling medium such as air or cooling water on the rail surface. In the embodiment, the start time and the end time of accelerated cooling is the start time and the end time of spraying of cooling water.

[Rolling Fatigue Test Conditions]

Test Conditions

- Tester: rolling fatigue tester (see FIG. 2)
- Test piece shape
- Rail: 141 lbs rail×2 m
- Wheel: AAR type (diameter of 920 mm)

Load

- Radial: 275 to 325 KN
- Thrust: 50 to 80 KN
- Lubrication: non-lubrication (wear resistance), oil lubrication (internal fatigue damage resistance)

Cumulative Passing Tonnage

- Non-lubrication (wear resistance): the passing tonnage was accumulated until the wear amount of a rail head surface layer portion reached over 25 mm
- Oil lubrication (wear resistance): the passing tonnage was accumulated until a crack was formed (200 MGT at the maximum) (Million Gross Tonnage)
  - the total weight of freight cars transported on rail; in this test, evaluated to be two times the weight of passing loads applied from wheels Evaluation

- Wear resistance: the cumulative passing tonnage was obtained when the wear amount reached 25 mm
- Internal fatigue damage resistance: using an ultrasonic flaw detector, whether or not cracks were formed in the head portion over the entire length of the rail, a crack having a length of 2 mm or longer was determined as a flaw, and the cumulative passing tonnage accumulated until the crack was formed was obtained. In the test, the evaluation was performed three times, and the minimum value thereof was obtained as a representative value of the cumulative passing tonnage accumulated until the crack was formed.

As a result, it was found that, when the hardness of the structure including the pearlite structure is less than Hv 360, the wear amount of the rail head surface layer portion reaches 25 mm at a small cumulative passing tonnage, and it is difficult to ensure wear resistance required for the rail head portion due to the progress of wear. In addition, it was found that, when the hardness of the structure including the pearlite structure is less than Hv 360, a coarse fatigue crack having a length of 2 mm or longer initiates and propagates in the rail head portion at a small cumulative passing tonnage, and internal fatigue damage resistance deteriorates.

In addition, it was found that, when the hardness of the pearlite structure is greater than Hv 500, due to embrittlement of the structure including the pearlite structure, a coarse fatigue crack having a length of 2 mm or longer initiates and propagates in the rail head portion at a small cumulative passing tonnage, and internal fatigue damage resistance deteriorates.

It was found from the above-described test that, in order to ensure wear resistance, surface damage resistance, and a certain level of internal fatigue damage resistance in the rail head portion, the hardness of the metallographic structure including the pearlite structure in a range from the outer surface of the head portion as the origin to a depth of 25 mm needs to be controlled to be in a range of Hv 360 to 500. Therefore, the hardness of the structure including the pearlite structure is limited to be in a range of Hv 360 to 500. In order to stably ensure wear resistance and surface damage resistance and to stably improve internal fatigue damage resistance, it is desirable that the hardness of the metallographic structure including the pearlite structure in a range from the outer surface of the head portion as the origin to a depth of 25 mm is controlled to be Hv 380 or greater, Hv 390 or greater, or Hv 400 or greater. For the same reason, it is desirable that the hardness of the metallographic structure including the pearlite structure in a range from the outer surface of the head portion as the origin to a depth of 25 mm may be Hv 480 or less, Hv 470 or less, or Hv 460 or less.

Regarding The hardness of the structure including the pearlite structure, the hardness is measured at 20 or more points at a measurement position (for example, a position at a depth of 2 mm from the outer surface of the head portion as the origin), and the average value thereof is adopted as the hardness value at the position. In the rail according to the embodiment, the area ratio of the pearlite structure is 95% or greater, but other structures (pro-eutectoid cementite, pro-eutectoid ferrite, martensite, bainite, and the like) are present in a range of 5% or less. Therefore, there may be a case where the hardness of the structure including the pearlite structure cannot be represented by one hardness value measured at one position.

A measurement method and measurement conditions of the hardness are as follows.

[Measurement Method and Measurement Conditions of Hardness of Rail Head Portion]

Measurement Method

- Device: Vickers hardness meter (load of 98 N)
- Collection of test piece for measurement: a sample was cut out from a transverse cross section of the rail head portion
- Pre-processing: the transverse cross section was polished with a diamond grit having an average grain size of 1 μm
- Measurement method: the hardness was measured according to JIS Z 2244

Calculation Method

Surface of head portion: the hardness was measured at 20 points at any position of a depth of 2 mm from the outer surface of the head portion, and the average value thereof was adopted as the hardness of the surface of the head portion Inside of head portion: the hardness was measured at 20 points at any position of a depth of 25 mm from the outer surface of the head portion, and the average value thereof was adopted as the internal hardness of the head surface portion In the rail according to the embodiment, when the hardness values at two positions including the position of a depth of 2 mm from the outer surface of the head portion as the origin and the position at a depth of 25 mm from the outer surface of the head portion as the origin are Hv 360 to 500, it can be said that the hardness of the range from the outer surface of the head portion as the origin to a depth of 25 mm is Hv 360 to 500.

<Reason for Limiting Grain Size and Number Density of V Nitride Including Cr at Position of Depth of 25 mm from Outer Surface of Head Portion as Origin>

Next, the reason for limiting a number density of a V nitride having a grain size of 0.5 to 4.0 nm and including Cr in a transverse cross section at a position at a depth of 25 mm from the outer surface of the head portion as the origin to be in a range of $1.0\times10^{17}$ to $5.0\times10^{17}$ $cm^{-3}$ will be described. In the embodiment, "V nitride including Cr" an inclusion that is formed of a V nitride and includes one or more Cr atoms. Whether or not Cr atoms are present can be verified using a three-dimensional atom probe (3DAP) described below.

First, the present inventors conducted a detailed investigation on the initiation state of a fatigue damage in the head portion after the rolling fatigue test. As a result, it was found that a crack having a length of less than 2 mm that is less likely to be detected in the investigation on whether or not a crack is formed using the ultrasonic flaw detector after the rolling fatigue test remains in the head portion of the rail that passes the evaluation test. Since the remaining cracks greatly affect the basic performance of the rail, it is necessary to prevent initiation of cracks in order to ensure safety. The present inventors examined a method of eliminating cracks.

As a result of a detailed investigation on the relationship between the cracks remaining in the rail head portion and the microscopic hardness, it was found that although the macroscopic hardness of the pearlite structure in the crack initiation portion does not change, a microscopic softened portion is present in ferrite of the pearlite structure. As a result, the present inventors found out that strains concentrate on the microscopic softened portion in ferrite inside the head portion due to contact with wheels such that a crack is likely to initiate.

Therefore, the present inventors thought that it is desirable to suppress microscopic softening of ferrite in the pearlite structure inside the head portion and to uniformize the material strength in a cross section of the inside of the head portion as much as possible.

The present inventors thought that precipitation hardening is effective for improving the microscopic hardness in the head portion. The present inventors searched for an element that is finely present in ferrite of the pearlite structure to cause precipitation hardening As a result of application examination of a carbide, a nitride, a carbonitride, or the like, it was found that a nitride is effective as the component for precipitation hardening from the viewpoints of stability of an increase in hardness and resistance to fatigue cracks. On the other hand, a carbide or a carbonitride includes carbon that is likely to be diffused or decomposed. Therefore, the stability to heat or stress is low, and a carbide or a carbonitride is not effective for stable precipitation hardening.

Further, the present inventors conducted a detailed investigation on a nitride. As a result, the present inventors found that it is desirable to use a V nitride as a base and further to increase stability. Further, it was found that the V nitride including Cr in which Cr is present in a complex way has very high stability to heat or stress, suppresses microscopic softening of ferrite in the pearlite structure inside the head portion, and stably improves the hardness of ferrite in the pearlite structure.

Therefore, in order to verify the effects of the V nitride including Cr, the present inventors conducted an investigation on a precipitate in the head portion and the hardness of the head portion by performing rail rolling using steel (hyper-eutectoid steel) including V, Cr, and nitrogen and performing a heat treatment to promote the formation of the V nitride including Cr. Further, the internal fatigue damage resistance of the rail was evaluated.

The present inventors conducted an investigation on a precipitate in the head portion and the hardness of the head portion by performing rail rolling using steel (hyper-eutectoid steel) and performing a heat treatment to promote the formation of the V nitride including Cr, the steel including that has a chemical composition including components 0.90% of C, 0.50% of Si, 0.70% of Mn, 0.50% of Cr, 0.0150% of P, and 0.0120% of S as a base, in which the V content is variable in a range of 0.010% to 0.200%, and the N content is variable in a range of 0.0030% to 0.0200%.

Further, in order to verify the effects of the V nitride including Cr, a rolling fatigue test was performed. Rail rolling, heat treatment conditions, a method of investigating the V nitride including Cr, measurement of the hardness of the head portion, and rolling fatigue test conditions are as follows.

[Actual Rail Rolling, Heat Treatment Test]

Steel Composition 0.90% of C, 0.50% of Si, 0.70% of Mn, 0.50% of Cr, 0.0150% of P, 0.0120% of S, 0.010% to 0.200% of V, and 0.0030% to 0.0200% of N (remainder consisting of Fe and impurities)

Rail Shape 141 lbs (weight: 70 kg/m)

Rolling and Heat Treatment Conditions

Finish rolling temperature (outer surface of head portion): 950° C.

Heat treatment conditions: rolling→accelerated cooling+controlled cooling

Accelerated cooling conditions (outer surface of head portion): cooling from 800° C. to temperature range of 660° C. to 580° C. at cooling rate of 5° C./sec Controlled cooling conditions (outer surface of head portion): after stopping accelerated cooling, the steel was retained in a temperature range of 580° C. to 660° C. for 5 to 120 sec, and then accelerated cooling was performed Retention at temperature during controlled cooling: the temperature was controlled by controlling the accelerated cooling rate, repeating the execution and the stop of accelerated cooling, and performing accelerated cooling according to reheat from the inside of the rail.

The method of investigating the V nitride including Cr is as follows.

[Method of Investigating V Nitride Including Cr]

Sample collection position: the inside of the head portion (a position at a depth of 25 mm from the outer surface of the head portion as the origin)

Pre-processing: three needle samples having a curvature radius of 30 to 80 nm were prepared using a focused ion beam (FIB) method Measuring device: three-dimensional atom probe (3DAP) method Measurement method By applying a DC voltage to the needle sample and further applying a pulse voltage or irradiating the needle sample with a pulse laser, ions of a constituent atom were field-evaporated from a needle tip. The ions were detected by a coordinate detector. The kind of the element was specified based on the ion time-of-flight. A three-dimensional element position and the number of atoms were specified based on the detected coordinates and the order of measurement.

Voltage: DC, voltage pulse (pulse ratio: 15% or greater), or laser pulse (40 pJ), sample temperature: 40 K to 70 K Determination Method and Count Method of V Nitride Including Cr Using IVAS software (manufactured by CAMECA), measurement data was analyzed. In a mass-to-charge ratio spectrum, a peak of 25.5 Da was identified as $V^{2+}$, and peaks of 25, 26, and 26.5 were identified as $Cr^{2+}$. Regarding N, a peak of $NN^{+}$ overlaps a main peak of $Fe^{2+}$. Therefore, N cannot be directly identified in the chemical composition of the rail according to the embodiment. Therefore, a peak of $NV^{2+}$ appearing at 32.5 Da was identified as N. The ions corresponding to the peak include the same amount of V as that of N.

After obtaining a 3D element map based on the coordinates at which the ions were detected and the order of measurement, a nitride precipitate was determined using atomic position data of V and CrN. To that end, a maximum separation method in the IVAS was used. This method is a method of separating groups of V, Cr, and N atoms in which the distance between the respective element is a specific value or less from the matrix to identify a precipitate. In this experiment, 1 nm was used as "the specific value".

After identifying the precipitate using the above-described method, the number of precipitates determined as the V precipitates including Cr in ferrite of the pearlite structure in a measurement region was counted using IVAS software.

In the pearlite structure, ferrite and cementite were present. In the rail according to the embodiment, the V nitride including Cr is used for strengthening the ferrite of the pearlite structure. Therefore, in this experiment, precipitates present at the center portion of ferrite of the pearlite structure were set as a target to be processed. The separation between cementite and ferrite in the measurement region can be determined based on the C distribution (the C concentration in cementite is 25% by atomic number ratio).

Method of Measuring Number Density of V Nitride Including Cr

The number density of the nitride including Cr determined using the above-described method was measured as follows.

The volume of an analytical region is estimated from the number of atoms in the analytical region to be measured by the 3DAP. In the case of general steel, assuming that the amount of alloy elements other than iron is extremely small such that all the atoms forming an analytical region are iron atoms, even when the volume of the analytical region is calculated based on the number of element atoms in the analytical region, it is considered that there is no significant difference between the calculated value and a true value. Therefore, the number of iron atoms is corrected using a detection rate of an ion detector, and the corrected value is divided by the atomic density of Fe (85 atoms/$nm^3$). In this case, the obtained value can be considered the volume ($nm^3$) of the measurement portion. The detection rate varies depending on devices, but the detection rate of the device used in this experiment was 35%. Therefore, the value obtained by dividing the detected number of atoms by 0.35 was estimated to be the number of atoms in the analytical region.

By dividing the number of precipitates in a region at the center portion of ferrite where the precipitates are distributed by the volume of the cut region, the number density of a V nitride having a grain size of 0.5 to 4.0 nm and including Cr in the ferrite of the pearlite structure can be obtained. For example, when one precipitate is observed in the measurement of the volume corresponding to 30000000 iron atoms in the ferrite, the volume of the analytical region is $3\times10^7$/0.35 (the detection rate of the ion detector)/85 atoms (the atomic density of Fe)=$1.0\times10^6$ $nm^3$, and the number density is $1.0\times10^{-6}$ $nm^3$. When the unit is converted into $cm^{-3}$, this value is multiplied by $10^{21}$. In this case, the number density is $1.0\times10^{17}$ ($cm^{-3}$). The average value of number densities of the three needle samples was adopted as the number density of the rail.

Method of Measuring Grain Size of V Nitride Including Cr

In this experiment, only the number density of the V nitride having a grain size of 0.5 to 4.0 nm and including Cr was set to a target to be measured. The reason for this is presumed that a V nitride having a grain size of less than 0.5 nm or more than 4.0 nm and including Cr does not contribute to improvement of the characteristics of the rail. Accordingly, in the evaluation of a V nitride including Cr, only a V nitride having a grain size of 0.5 to 4.0 nm was extracted from V nitrides including Cr, and the number thereof was counted.

A method of measuring the grain size of each of the V nitrides including Cr is as follows. First, the total number of V and Cr atoms forming the V nitride including Cr is obtained. Assuming that the same number of N atoms as the number of V and Cr atoms are present, the crystal structure is estimated to be NaCl type, and the volume of each of precipitates is estimated. By using literature values of 0.413 nm and 0.415 nm as the lattice constants of VN and CrN, respectively, and using 0.414 nm as the lattice constant of the V nitride including Cr, the number of atoms per 1 $nm^3$ is about 113 atoms. Based on the number of atoms in the precipitate, the volume of the precipitate can be estimated. Here, assuming that the V nitride including Cr was a sphere, the diameter of the sphere was adopted as the grain size of the V nitride including Cr. That is, the sphere equivalent diameter of the V nitride including Cr was obtained.

As a result of a detailed investigation on the V nitride including Cr that is formed in the head portion of the rail that is rolled and heat-treated, it was found that, by including V, Cr, and N in the chemical composition of the rail and further controlling the heat treatment conditions after rolling, the given amount of V nitride including of Cr can be formed in ferrite of the pearlite structure.

In addition, it was found that, by forming the V nitride having a grain size of 0.5 to 4.0 nm and including Cr in ferrite of the pearlite structure, a microscopic softened portion in the ferrite of the pearlite structure inside the rail head portion decreases, and the hardness of ferrite in the pearlite structure is stable.

Further, it was found that, by controlling the number density of a V nitride having a grain size of 0.5 to 4.0 nm and including Cr in the head portion (position of a depth of 25 mm from the outer surface of the head portion as the origin) to be in a range of $1.0\times10^{17}$ to $5.0\times10^{17}$ $cm^{-3}$, a microscopic softened portion decreases, and the hardness is stably uniformized.

The reason why the grain size of the V nitride including Cr of which the number density is to be controlled is limited to be in a range of 0.5 to 4.0 nm is that, when the V nitride including Cr precipitates in ferrite of the pearlite structure, the above-described grain size is most effective for reducing a microscopic softened portion in the pearlite structure and uniformizing the hardness. AV nitride having a grain size of less than 0.5 nm or more than 4.0 nm and including Cr does not contribute to improvement of the characteristics of the rail, and thus it is presumed that the amount thereof is preferably small. However, it is presumed that, as long as the number density of the V nitride having a grain size of 0.5 to 4.0 nm and including Cr is maintained in the predetermined range, the magnitude of the number density of them does not affect the characteristics of the rail. In the evaluation of the V nitride including Cr, a V nitride having a grain size of less than 0.5 nm or more than 4.0 nm is ignored.

Figure 2:
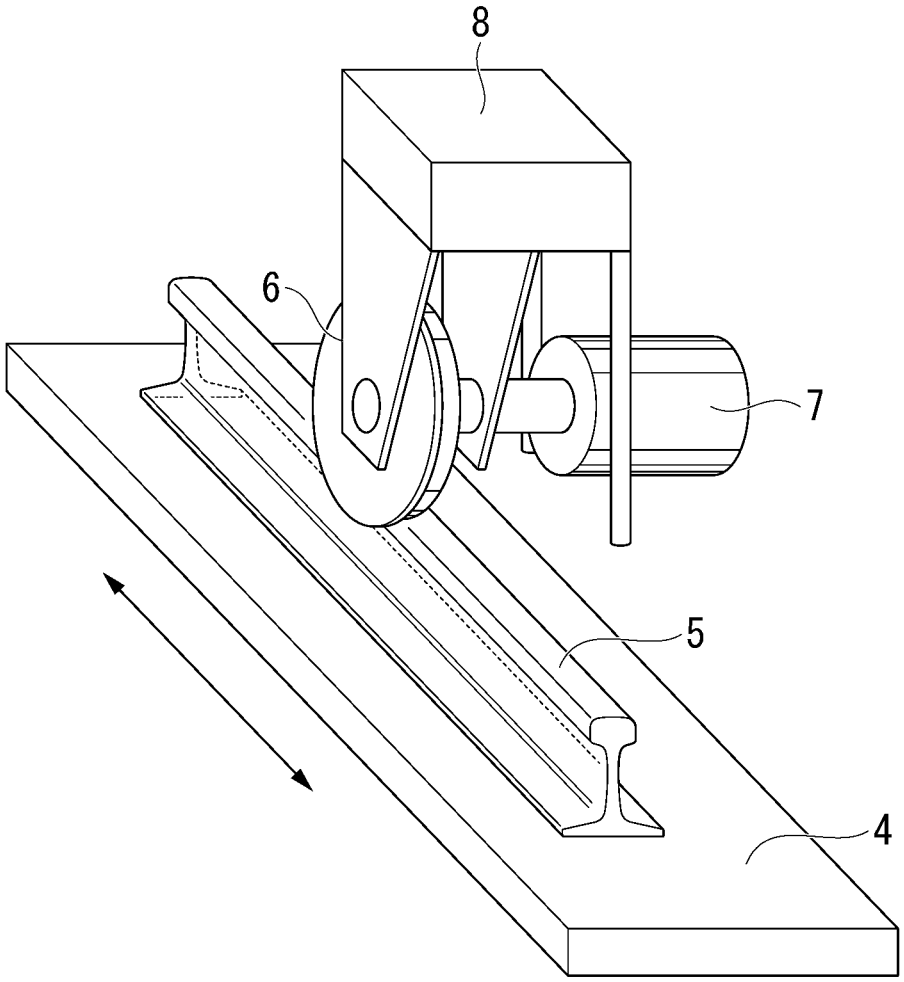
FIG. 2 is a view showing the outline of a rolling fatigue tester.

Using the rolling fatigue tester shown in FIG. 2, the present inventors evaluated the internal fatigue damage resistance of the rail in which the number density of the V nitride having a grain size of 0.5 to 4.0 nm and including Cr at a position at a depth of 25 mm from the outer surface of the head portion as the origin was in a range of $1.0\times10^{17}$ to $5.0\times10^{17}$ $cm^{-3}$. The components of the rail used in the test, the metallographic structure, the hardness, and the rolling fatigue test conditions are as follows.

[Rail]

Steel Element 0.90%/c of C, 0.50% of Si, 0.70% of Mn, 0.50% of Cr, 0.0150% of P, 0.0120% of S, 0.010% to 0.200% of V, and 0.0030% to 0.0200% of N (the remainder consisting of Fe and impurities)

Rail Shape 141 lbs (weight: 70 kg/m)

Metallographic Structure

Pearlite

Hardness

Hv 360 to 500 (range from the outer surface of the head portion as the origin to a depth of 25 mm)

[Rolling Fatigue Test Conditions]

Test Conditions

Tester: rolling fatigue tester (see FIG. 2)

Test Piece Shape

Rail: 141 lbs rail×2 m

Wheel: AAR type (diameter of 920 mm)

Load

Radial: 275 to 325 KN

Thrust: 50 to 80 KN

Lubrication: oil lubrication

Cumulative passing tonnage: the passing tonnage was accumulated until a crack was formed (200 MGT at the maximum)

(Million Gross Tonnage)

the total weight of freight cars transported on rail; in this test, evaluated to be two times the weight of passing loads applied from wheels Evaluation Using an ultrasonic flaw detector, whether or not cracks were formed in the head portion over the entire length of the rail, a crack having a length of 0.5 mm or longer was determined as a flaw, and the passing tonnage accumulated until the crack was formed was obtained as an evaluation index representing the internal fatigue damage resistance. In the test, the evaluation was performed three times, and the minimum value thereof was obtained as a representative value of the cumulative passing tonnage accumulated until the crack was formed.

As a result, it was found that, due to the formation of the V nitride including Cr, cracks do not remain in the head portion of the rail and the internal fatigue damage resistance of the rail is significantly improved.

As described above, by controlling the number density of a V nitride having a grain size of 0.5 to 4.0 nm and including Cr in the head portion (position of a depth of 25 mm from the outer surface of the head portion as the origin) to be in a range of $1.0\times10^{17}$ to $5.0\times10^{17}$ $cm^{-3}$, a microscopic softened portion in the ferrite of the pearlite structure inside the rail head portion is suppressed, and the remaining of cracks does not occur in the rail head portion, and the internal fatigue damage resistance of the rail is significantly improved.

Accordingly, in the ferrite of the pearlite structure at a position at a depth of 25 mm from the outer surface of the head portion as the origin, the number density of the V nitride having a grain size of 0.5 to 4.0 nm and including Cr is in a range of $1.0\times10^{17}$ to $5.0\times10^{17}$ $cm^{-3}$.

When the amount of the V nitride having a grain size of 0.5 to 4.0 nm and including Cr formed is less than $1.0\times10^{17}$ $cm^{-3}$, the improvement of the microscopic softened portion in the ferrite of the pearlite structure inside the head portion (the position of a depth of 25 mm from the outer surface of the head portion as the origin) is not sufficient, and the improvement of the internal fatigue damage resistance is not recognized. On the other hand, when the amount of the V nitride having a grain size of 0.5 to 4.0 nm and including Cr formed is more than $5.0\times10^{17}$ $cm^{-3}$, the number density of the precipitate is excessively large, the pearlite structure in the head portion (position of a depth of 25 mm from the outer surface of the head portion as the origin) is embrittled, and the internal fatigue damage resistance deteriorates due to the initiation and propagation of cracks. Therefore the number density of the V nitride having a grain size of 0.5 to 4.0 nm and including Cr at a position at a depth of 25 mm from the outer surface of the head portion as the origin is limited to be in a range of $1.0\times10^{17}$ to $5.0\times10^{17}$ $cm^{-3}$. In order to improve the microscopic softened portion in the ferrite of the pearlite structure and to stably improve the internal fatigue damage resistance, it is desirable to control the number density of the V nitride having a grain size of 0.5 to 4.0 nm and including Cr to be $1.5\times10^{17}$ $cm^{-3}$ or more, $1.8\times10^{17}$ $cm^{-3}$ or more, or $2.0\times10^{17}$ $cm^{-3}$ or more. For the same reason, the number density of the V nitride having a grain size of 0.5 to 4.0 nm and including Cr may be controlled to be $4.0\times10^{17}$ $cm^{-3}$ or less, $3.5\times10^{17}$ $cm^{-3}$ or less, or $3.0\times10^{17}$ $cm^{-3}$ or less.

The reason why the position of a depth of 2 mm from the outer surface of the head portion as the origin is selected as the surface of the head portion and the position of a depth of 25 mm from the outer surface of the head portion as the origin is selected as the inside of the head portion is that, at these positions, the wear resistance and the internal fatigue damage resistance these positions are most significantly shown as a product rail. The wear resistance and the internal fatigue damage resistance of the rail according to the embodiment can be improved by controlling the hardness of the positions. The method of measuring the hardness is as described above. As long as the conditions are satisfied, any position may be selected as a measurement position of the hardness so as to obtain a numerical value representing the entire range from the head top portion to the corner head portion of the rail.

The grain size and the number density of the V nitride including Cr can be controlled by controlling mainly the cooling rate during accelerated cooling and the temperature retention conditions during controlled cooling after stopping accelerated cooling.

The grain size of the V nitride including Cr is controlled by controlling mainly the temperature and the holding time during controlled cooling. By setting the temperature to be high and setting the holding time to be long, the V nitride including Cr grows, and the grain size of the V nitride including Cr increases. On the other hand, by setting the temperature to be low and setting the holding time to be short, the growth of the V nitride including Cr is suppressed, and the grain size thereof decreases.

In addition, the number density is controlled by controlling mainly the temperature during controlled cooling. When the temperature during controlled cooling is high, the formation of the V nitride including Cr is promoted, and the number density thereof increases. On the other hand, when the temperature during controlled cooling is low, the formation of the V nitride including Cr is suppressed, and the number density thereof decreases.

As described above, the grain size and the number density of the V nitride including Cr can be controlled by controlling mainly the temperature retention conditions during controlled cooling after stopping accelerated cooling, and both the grain size and the number density of the V nitride including Cr can be limited to predetermined ranges by controlling the temperature and the holding time during controlled cooling.

<Reason for Controlling Number of V Atoms (VA) and Number of Cr Atoms (CA) to Satisfy Following Expression 1>

Next, the reason why the present inventors limited the ratio of the number of Cr atoms to the number of V atoms in the V nitride including Cr in order to further improve the internal fatigue damage resistance of the rail will be described.

As described above, by limiting the number density of the V nitride having the predetermined grain size and including Cr to be in the predetermined range in the predetermined position, the initiation of cracks having a length of less than 2 mm that cannot be sufficiently suppressed by the control of the amount and the hardness of the pearlite structure can be suppressed. As a result, the wear resistance and the internal fatigue damage resistance of the rail according to the embodiment can be sufficiently improved. However, from the viewpoint of further improving the safety, the present inventors conducted an investigation on a method of improving the characteristics during long-term use. As a result of a detailed investigation on the rail having undergone the above-described fatigue test, it was found that fine cracks (having a length of less than 0.5 mm) may be present around the V nitride including Cr. The present inventors conducted an investigation on the method of eliminating the fine cracks.

Here, the present inventors conducted a detailed investigation on a relationship between the composition of the V nitride including Cr and fine cracks present around the V nitride. The investigation method is as follows.

[Method of Investigating Fine Cracks]

Preparation of Sample

The rail was cut to prepare a sample from a position at a depth of 25 mm from the outer surface of the head portion as the origin in the head portion Pre-Processing: A Cross Section was Polished with a Diamond Grit Observation Method Device: a scanning electron microscope Magnification: 10000 to 100000

Observation position: the periphery of a V nitride having a grain size of 1 to 3 nm and including Cr on an observed section was observed in detail, and assuming that the nitride observed with a scanning electron microscope was a circle, the grain size thereof was obtained as the diameter of the circle.

[Method of Investigating Composition of V Nitride Including Cr]

The sample collection position, the pre-processing, the measuring device, and the determination method of the V nitride including Cr are the same as those of the above-described "Method of investigating V Nitride including Cr".

Calculation of Ratio Between Numbers of V and Cr Atoms and Compositions

Nitrides that were determined as the V nitride including Cr are analyzed using the above-described method. Regarding each of the nitrides, the numbers of V and Cr atoms are counted, and a ratio of the number of Cr atoms (CA) to the number of V atoms (VA) is calculated. As precipitates to be measured, five or more are randomly selected from V nitrides having a grain size of 0.5 to 4.0 nm and including Cr, and the average value thereof is adopted as a representative value. Hereinafter, the average value of the ratio of the number of Cr atoms (CA) to the number of V atoms (VA) in the V nitride having a grain size of 0.5 to 4.0 nm and including Cr in the ferrite of the pearlite structure at a position at a depth of 25 mm from the outer surface of the head portion will be referred to as "CA/VA". The average value of CA/VA in the three needle samples is adopted as the CA/VA of the rail.

Figure 3:
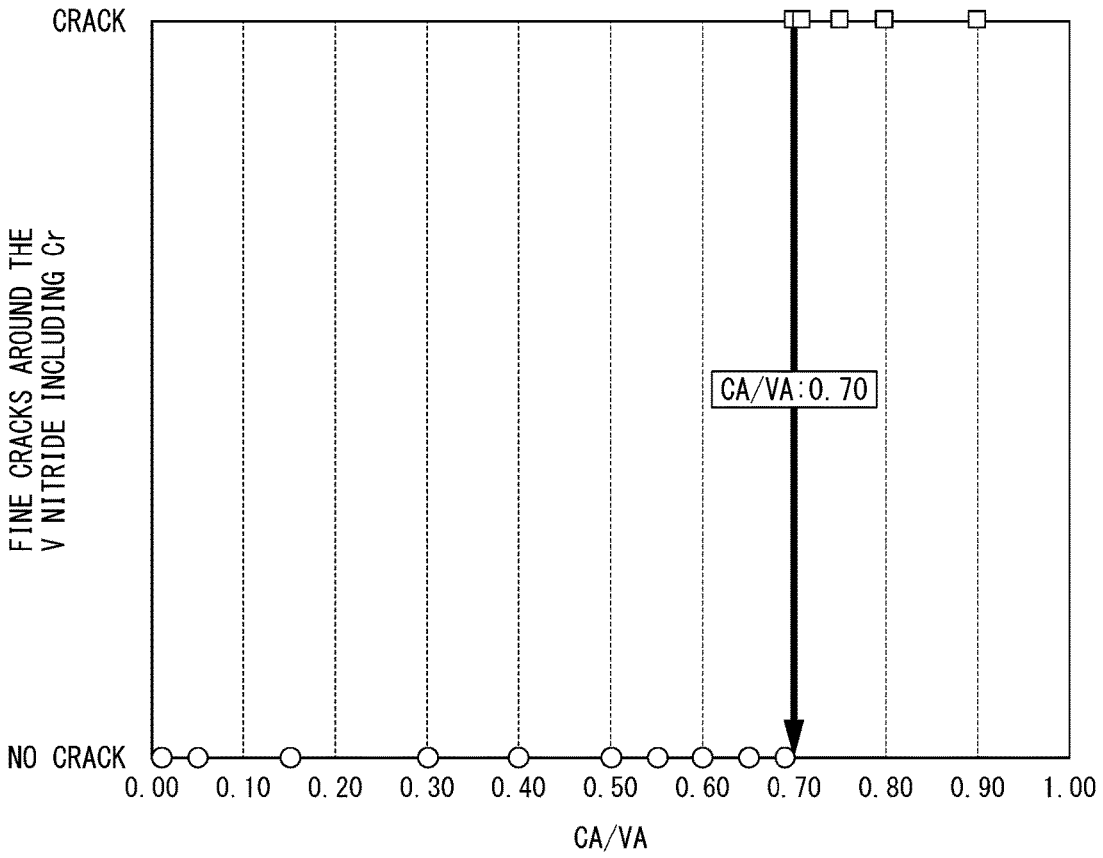
FIG. 3 is a diagram showing the relationship the average value (CA/VA) of a ratio of the number of Cr atoms (CA) to the number of V atoms (VA) in a V nitride having a grain size of 0.5 to 4.0 nm and including Cr and the presence or absence of fine cracks in the periphery of a V carbonitride during a rolling fatigue test.

As a result of a detailed investigation, it was found that the initiation of fine cracks having a length of less than 0.5 mm and CA/VA have a correlation, and as the number of Cr atoms (CA) increases, the hardness of the V nitride including Cr increases significantly, and the amount of fine cracks (less than 0.5 mm) of primary phase around the V nitride formed tends to increase. As a result of a more detailed investigation, as shown in FIG. 3, it was found that the initiation of fine cracks is eliminated by controlling CA/VA to 0.70 or less. CA/VA may be 0.65 or less, 0.60 or less, or 0.55 or less.

From the viewpoint of preventing fine cracks, it is not necessary to limit the lower limit value of CA/VA. However, since the V nitride including Cr includes Cr, CA/VA cannot be set to 0. According to the experiment by the present inventors, a rail having CA/VA of less than 0.01 was not found. Therefore, the lower limit value of CA/VA may be 0.01, 0.02, or 0.05. In addition, it is presumed that a V nitride having a grain size of less than 0.5 nm or more than 4.0 nm and including Cr does not substantially affect the characteristics of the rail. Therefore, this V nitride is excluded from the measurement of CA/VA.

$$0.01 \leq CA/VA \leq 0.70 \qquad \text{Expression 1.}$$

Based on these results, it was found that, in order to suppress and prevent the initiation of cracks and fine cracks in the head portion and to further improve the safety of the rail, it is preferable to control not only the grain size and number density of the V nitride including Cr but also the composition of the V nitride including Cr as the origin of cracks.

CA/VA can be controlled by controlling mainly the temperature retention conditions during controlled cooling after stopping accelerated cooling.

CA/VA is controlled by controlling mainly the temperature during controlled cooling. When the temperature during controlled cooling is high, the number of V atoms in the V nitride including Cr increases, and CA/VA decreases. On the other hand, when the temperature during controlled cooling is low, the number of Cr atoms in the V nitride including Cr increases, and CA/VA increases.

As described above, CA/VA can be controlled by controlling mainly the temperature retention conditions during controlled cooling after stopping accelerated cooling. CA/VA can be limited to a predetermined range by controlling the temperature during temperature retention.

<Reason for Limiting Chemical Composition of Rail>

The reason for limiting the chemical composition of rail steel (steel as a material of the rail) in the rail according to the embodiment will be described in detail. Hereinafter the unit "%" representing the amount of each element represents "mass %".

C: 0.75% to 1.20%

C is an element effective for promoting pearlitic transformation and ensuring wear resistance. When the C content is less than 0.75%, in this component system, the minimum strength and wear resistance required for the rail cannot be maintained. In addition, when the C content is less than 0.75%, a pro-eutectoid ferrite structure is formed, and the wear resistance of the rail deteriorates significantly. Further, when the C content is less than 0.75%, a soft pro-eutectoid ferrite structure in which fatigue cracks are likely to initiate in the head portion is likely to be formed, and internal fatigue damage is likely to occur. On the other hand, when the C content is greater than 1.20%, the pro-eutectoid cementite structure is likely to be formed in the head portion, fatigue cracks initiate from the interface between the pearlite structure and the pro-eutectoid cementite structure, and internal fatigue damage is likely to occur. Therefore, the C content is adjusted to be in a range of 0.75% to 1.20%. In order to stabilize the formation of the pearlite structure and to improve the internal fatigue damage resistance, it is preferable that the C content is 0.80% or greater, 0.83% or greater, or 0.85% or greater. For the same reason, it is preferable that the C content is 1.10% or less, 1.05% or less, or 1.00% or less.

Si: 0.10% to 2.00%

Si is an element which is solid-solubilized in ferrite of the pearlite structure, increases the hardness (strength) of the rail head portion, and improves the wear resistance. However, when the Si content is less than 0.10%, these effects cannot be sufficiently obtained. On the other hand, when the Si content is greater than 2.00%, a large amount of surface dents are generated during hot rolling of the rail. Further, when the Si content is greater than 2.00%, hardenability significantly increases, and a martensite structure is formed in the rail head portion, and wear resistance deteriorates. Therefore, the Si content is adjusted to be in a range of 0.10% to 2.00%. In order to stabilize the formation of the pearlite structure and to improve the wear resistance and the internal fatigue damage resistance, it is preferable that the Si content is 0.20% or greater, 0.4% or greater, or 0.50% or greater. For the same reason, it is preferable that the Si content is 1.80% or less, 1.50% or less, or 1.30% or less.

Mn: 0.10% to 2.00%

Mn is an element which increases the hardenability, stabilizes pearlitic transformation, refines the lamellar spacing of the pearlite structure, ensures the hardness of the pearlite structure, and further improves the wear resistance or the internal fatigue damage resistance. However, when the Mn content is less than 0.10%, the wear resistance is not improved. In addition, when the Mn content is less than 0.10%, a soft pro-eutectoid ferrite structure in which fatigue cracks are likely to initiate in the head portion is formed, and it is difficult to ensure internal fatigue damage resistance. On the other hand, when the Mn content is greater than 2.00%, the hardenability is significantly increased, and the martensite structure is formed in the rail head portion, and the wear resistance or the surface damage resistance deteriorates. Therefore, the Mn content is adjusted to be in a range of 0.10% to 2.00%. In order to stabilize the formation of the pearlite structure and to improve the wear resistance or the internal fatigue damage resistance of the rail, it is preferable that the Mn content is 0.40% or greater, 0.50/6 or greater, or 0.60% or greater. For the same reason, it is preferable that the Mn content is 1.80% or less, 1.50% or less, or 1.30% or less.

Cr: 0.10% to 1.20%

Cr is an element which refines the lamellar spacing of the pearlite structure, improves the hardness of the pearlite structure, and the wear resistance of the rail by increasing the equilibrium transformation temperature of the steel and increasing the supercooling degree. Further, Cr is an element which suppresses microscopic softening of ferrite of the pearlite structure in the rail head portion and improves the internal fatigue damage resistance in the head portion by precipitation hardening caused by the formation of the fine V nitride including Cr in the ferrite of the pearlite structure. However, when the Cr content is less than 0.10%, the effects are small, the number of fine V nitrides including Cr precipitated in the ferrite of the pearlite structure is small, the improvement of the microscopic softened portion of the ferrite of the pearlite structure in the rail head portion is insufficient, and the improvement of the internal fatigue damage resistance is not recognized. On the other hand, when the Cr content is greater than 1.20%, hardenability increases significantly, a bainite structure or a martensite structure is formed in the rail head portion, and thus the wear resistance or the surface damage resistance of the rail deteriorates. Further, when the Cr content is greater than 1.20%, the number of fine V nitrides including Cr is excessively large, the pearlite structure in the rail head portion (position of a depth of 25 mm from the outer surface of the head portion as the origin) is embrittled, and the internal fatigue damage resistance of the rail deteriorates due to the initiation and propagation of cracks. Therefore, the Cr content is set to be in a range of 0.10% to 1.20%. In order to stabilize the formation of the pearlite structure and to stably form the V nitride including Cr to improve the wear resistance or the internal fatigue damage resistance of the rail, it is preferable that the Cr content is 0.30% or greater, 0.35% or greater, or 0.40% or greater. For the same reason, it is preferable that the Cr content is 1.10% or less, 1.00% or less, or 0.90% or less.

V: 0.010% to 0.200%

V is an element which suppresses microscopic softening of ferrite of the pearlite structure in the rail head portion and improves the internal fatigue damage resistance of the rail by precipitation hardening caused by the formation of the fine V nitride including Cr in the ferrite of the pearlite structure in the process of cooling after hot rolling of the rail. However, when the V content is less than 0.010%, the number of fine V nitrides including Cr precipitated in the ferrite of the pearlite structure is small, the improvement of the microscopic softened portion of the ferrite of the pearlite structure in the rail head portion is insufficient, and the improvement of the internal fatigue damage resistance of the rail is not recognized. On the other hand, when the V content is greater than 0.200%, the number of fine V nitrides including Cr is excessively large, the pearlite structure in the rail head portion (position of a depth of 25 mm from the outer surface of the head portion as the origin) is embrittled, and the internal fatigue damage resistance of the rail deteriorates due to the initiation and propagation of cracks. Therefore, the V content is set to be in a range of 0.010% to 0.200%. In order to stably form the V nitride including Cr to improve the internal fatigue damage resistance of the rail, it is preferable that the V content is 0.030% or greater, 0.035% or greater, or 0.040% or greater. For the same reason, it is preferable that the V content is 0.180% or less, 0.150% or less, or 0.100% or less.

N: 0.0030% to 0.0200%

N is an element which promotes the formation of the V nitride including Cr in ferrite of the pearlite structure in the process of cooling after hot rolling of the rail by being included together with Cr and V. When the fine V nitride including Cr is formed, microscopic softening of ferrite of the pearlite structure in the rail head portion is suppressed, and the internal fatigue damage resistance of the rail is improved. However, when the N content is less than 0.0030%, the number of fine V nitrides including Cr formed in the ferrite of the pearlite structure is small, the improvement of the microscopic softened portion of the ferrite of the pearlite structure in the rail head portion is insufficient, and the improvement of the internal fatigue damage resistance of the rail is not recognized. On the other hand, when the N content is greater than 0.0200%, the number of fine V nitrides including Cr is excessively large, the pearlite structure in the rail head portion (position of a depth of 25 mm from the outer surface of the head portion as the origin) is embrittled, and the internal fatigue damage resistance of the rail deteriorates due to the initiation and propagation of cracks. Further, when the N content is greater than 0.0200%, it is difficult to solid-solubilize N in the steel, bubbles as the origin of fatigue damage are formed, and internal fatigue damage is likely to occur. Therefore, the N content is set to be in a range of 0.0030% to 0.0200%. In order to stably form the V nitride including Cr to improve the internal fatigue damage resistance, it is preferable that the N content is 0.0080% or greater, 0.0090% or greater, or 0.0100% or greater. For the same reason, it is preferable that the N content is 0.0180% or less, 0.0150% or less, or 0.0120% or less.

P. 0.0250% or Less

P is an impurity element which is included in the steel, and the amount thereof can be controlled by refining the steel in a converter. It is preferable that the P content is as small as possible. However, when the P content is greater than 0.0250%, the pearlite structure is embrittled, brittle cracks initiate in the head portion, and the internal fatigue damage resistance of the rail deteriorates. Therefore, the P content is limited to 0.0250% or less. The P content may be 0.220% or less, 0.200% or less, or 0.180% or less. The lower limit of the P content is not limited and may be 0%. However, in consideration of dephosphorization capacity and economic efficiency in the refining process, the lower limit value of the P content may be 0.0020%, 0.0030%, or 0.0050%.

S: 0.0250% or Less

S is an impurity element which is included in the steel, and the amount thereof can be controlled by performing desulfurization in a molten iron ladle. It is preferable that the S content is as small as possible. However, when the S content is greater than 0.0250%, an inclusion of a coarse MnS-based sulfide is likely to be formed, fatigue cracks initiate in the head portion due to stress concentration on the periphery of the inclusion, and thus the internal fatigue damage resistance of the rail deteriorates. Therefore, the S content is limited to 0.0250% or less. The S content may be 0.220% or less, 0.200% or less, or 0.180% or less. The lower limit of the S content is not limited and may be 0%. However, in consideration of desulfurization capacity and economic efficiency in the refining process, the lower limit value of the S content may be 0.0020%, 0.0030%, or 0.0050%.

Basically, the rail according to the embodiment has the above-described chemical composition, and the remainder consists of Fe and impurities. Here, the impurities refer to elements which are, when steel is industrially manufactured, incorporated from raw materials such as ore or scrap or incorporated by various factors of the manufacturing process, and the impurities are allowed to be included in the steel in a range not adversely affecting the characteristics of the rail according to the embodiment. However, instead of a part of Fe in the remainder, optionally, the remainder may further include one or more selected from the group consisting of Mo, Co, B, Cu, Ni, Nb, Ti, Mg, Ca, REM, Zr, and Al, in ranges described below, for the purpose of improving the wear resistance and the internal fatigue damage resistance due to an increase in hardness (strength) of the pearlite structure, improving the toughness, preventing a welded heat-affected zone from being softened, and controlling the cross sectional hardness distribution in the head portion. Specifically, the action of each of the optional elements is as follows.

(Group a) Mo increases the equilibrium transformation point, refines the lamellar spacing of the pearlite structure, and improves the hardness of the rail.

(Group b) Co refines the lamellar structure on the wear surface and increases the hardness of the wear surface.

(Group c) B reduces cooling rate dependence of the pearlitic transformation temperature to make the hardness distribution in the rail head portion uniform.

(Group d) Cu is solid-solubilized in ferrite of the pearlite structure and increases the hardness of the rail. Ni improves the toughness and hardness of the pearlite structure and prevents a heat affected zone of a welded joint from being softened.

(Group e) Nb and Ti improve the fatigue strength of the pearlite structure by precipitation hardening of a carbide or a nitride formed in the process of hot rolling or cooling after hot rolling. In addition, Nb and Ti causes a carbide or a nitride to be stably formed during re-heating and prevent a heat affected zone of a welded joint from being softened.

(Group f) Mg, Ca, and REM finely disperse a MnS-based sulfide and reduce the internal fatigue damage derived from the inclusion.

(Group g) Zr suppresses formation of a segregation zone of a cast piece center portion and suppresses formation of a pro-eutectoid cementite structure or a martensite structure by increasing the equiaxed crystal ratio of a solidification structure.

(Group h) Al is an element which functions as a deoxidation material. In addition, Al shifts the eutectoid transformation temperature to a high temperature side and contributes to an increase in hardness (strength) of the pearlite structure.

Therefore, these elements may be included in order to obtain the above-described effects. In addition, even if the amount of each of the elements is less than or equal to a range described below, the characteristics of the rail according to the embodiment do not deteriorate. Further, since it is not necessary to include these elements, the lower limit thereof is 0%.

Mo: Preferably 0.01% to 0.50%

Mo is an element which refines the lamellar spacing of the pearlite structure and improves the hardness (strength) of the pearlite structure by increasing the equilibrium transformation temperature and increasing the supercooling degree. As a result of that, the wear resistance and the internal fatigue damage resistance of the rail are improved. However, when the Mo content is less than 0.01%, the effects are small, and the effect of improving the hardness of rail steel cannot be obtained. Meanwhile, when the Mo content is greater than 0.50%, the transformation rate decreases significantly, a martensite structure is formed in the rail head portion, and thus the wear resistance deteriorates. Therefore, it is preferable that the Mo content is set to be in a range of 0.01% to 0.50% when Mo is included.

Co: Preferably 0.01% to 1.00%

Co is an element which is solid-solubilized in ferrite of the pearlite structure, refines the lamellar structure of the pearlite structure right, increases the hardness (strength) of the pearlite structure, and improves the wear resistance and the internal fatigue damage resistance of the rail. However, when the Co content is less than 0.01%, the refining of the lamellar structure is not promoted, and the effect of improving the wear resistance or the internal fatigue damage resistance cannot be obtained. On the other hand, when the Co content is greater than 1.00%, the above-described effects are saturated, and there may be a case where the lamellar structure depending on the content cannot be refined. In addition when the Co content is greater than 1.00%, the economic efficiency may deteriorate due to an increase in alloy addition costs. Therefore, it is preferable that the Co content is set to be in a range of 0.01% to 1.00% when Co is included.

B: Preferably 0.0001% to 0.0050%

B is an element which causes an iron-boron carbide ($Fe_{23}(CB)_6$) to be formed in an austenite grain boundary and reduces cooling rate dependence of the pearlitic transformation temperature due to the effect of promoting pearlitic transformation. Further, B is an element which imparts a more uniform hardness distribution to a rail from the outer surface of the head portion to the inside thereof and increases the service life of the rail. However, when the B content is less than 0.0001%, the effects are not sufficient, and the improvement of the hardness distribution in the rail head portion is not recognized. On the other hand, when B content is greater than 0.0050%, a coarse iron-boron carbide is formed, brittle fracture is promoted, and the toughness of the rail may deteriorate. Therefore, it is preferable that the B content is set to be in a range of 0.0001% to 0.0050% when B is included.

Cu: Preferably 0.01% to 1.00%

Cu is an element which is solid-solubilized in ferrite of the pearlite structure and improves the hardness (strength) by solid solution strengthening such that the wear resistance and the internal fatigue damage resistance of the rail are improved. However, when the Cu content is less than 0.01%, the effects cannot be obtained. On the other hand, when the Cu content is greater than 1.00%, a martensite structure is formed in the rail head portion due to significant improvement of hardenability, and the wear resistance may deteriorate. Therefore, it is preferable that the Cu content is set to be in a range of 0.01% to 1.00% when Cu is included.

Ni: Preferably 0.01% to 1.00%

Ni is an element which improves the toughness of the pearlite structure and improves the hardness (strength) by solid solution strengthening, and improves the wear resistance and the internal fatigue damage resistance of the rail. Further, Ni is an element which is bonded to Ti such that an intermetallic compound $Ni_3Ti$ finely precipitates in a welded heat-affected zone and suppresses softening by precipitation hardening. In addition, Ni is an element which suppresses embrittlement of a grain boundary in steel containing Cu. However, when the Ni content is less than 0.01%, these effects are significantly small. On the other hand, when the Ni content is greater than 1.00%, a martensite structure is formed in the rail head portion due to significant improvement of hardenability, and the wear resistance of the rail may deteriorate. Therefore, it is preferable that the Ni content is set to be in a range of 0.01% to 1.00% when Ni is included.

Nb: Preferably 0.0010% to 0.0500%

Nb is an element which precipitates as a Nb carbide and/or a Nb nitride in the process of cooling after hot rolling, increases the hardness (strength) of the pearlite structure by precipitation hardening, and improves the wear resistance and the internal fatigue damage resistance of the rail. Further, Nb is an element which is effective for preventing a heat affected zone of a welded joint from being softened by causing a Nb carbide or a Nb nitride to be stably formed in a range of a low temperature range to a high temperature range in a heat affected zone re-heated to a temperature range of the $Ac_1$ point or lower. However, when the Nb content is less than 0.0010%, these effects cannot be sufficiently obtained, and improvement of the hardness (strength) of the pearlite structure is not recognized. On the other hand, when Nb content is greater than 0.0500%, the precipitation hardening of the Nb carbide or the Nb nitride is excessive, the pearlite structure is embrittled, and the internal fatigue damage resistance of the rail may deteriorate. Therefore, it is preferable that the Nb content is set to be in a range of 0.0010% to 0.0500% when Nb is included.

Ti: Preferably 0.0030% to 0.0500%

Ti is an element which precipitates as a Ti carbide and/or a nitride in the process of cooling after hot rolling, increases the hardness (strength) of the pearlite structure by precipitation hardening, and improves the wear resistance and the internal fatigue damage resistance of the rail. Further, Ti is an element effective for preventing embrittlement of a welded joint by refining the structure of a heat affected zone heated to the austenitic temperature using the configuration in which the precipitated Ti carbide or Ti nitride is not dissolved during re-heating of welding. However, when the Ti content is less than 0.0030%, these effects are small. On the other hand, when the Ti content is greater than 0.0500%, a coarse Ti carbide or Ti nitride is formed, and fatigue cracks initiate due to stress concentration such that the internal fatigue damage resistance may deteriorate. Therefore, it is preferable that the Ti content is set to be in a range of 0.0030% to 0.0500% when Ti is included.

Mg: Preferably 0.0005% to 0.0200%

Mg is an element which is bonded to S to form a fine sulfide. This Mg sulfide finely disperses MnS, relaxes stress concentration, and improves the internal fatigue damage resistance of the rail. However, when the Mg content is less than 0.0005%, these effects are small. On the other hand, when the Mg content is greater than 0.0200%, a coarse Mg oxide is formed, and fatigue cracks initiate due to stress concentration such that the internal fatigue damage resistance of the rail may deteriorate. Therefore, it is preferable that the Mg content is set to be in a range of 0.0005% to 0.0200/o when Mg is included.

Ca: Preferably 0.0005% to 0.0200%

Ca is an element which has a strong bonding force to S and forms CaS (sulfide). This CaS finely disperses MnS, relaxes stress concentration, and improves the internal fatigue damage resistance of the rail. However, when the Ca content is less than 0.0005%, these effects are small. On the other hand, when the Ca content is greater than 0.0200%, a coarse Ca oxide is formed, and fatigue cracks initiate due to stress concentration such that the internal fatigue damage resistance may deteriorate. Therefore, it is preferable that the Ca content is set to be in a range of 0.0005% to 0.0200% when Ca is included.

REM: Preferably 0.0005% to 0.0500%

REM is a deoxidation and desulfurization element and forms an REM oxysulfide ($REM_2O_2S$) serving as a nucleus for forming a Mn sulfide-based inclusion when included. Further, since the melting point of the oxysulfide ($REM_2O_2S$) is high, elongation of the Mn sulfide-based inclusion after rolling is suppressed. As a result, when REM is included, MnS is finely dispersed, the stress concentration is relaxed, and the internal fatigue damage resistance of the rail is improved. However, when the REM content is less than 0.0005%, REM is insufficient as the nucleus for forming a MnS-based sulfide, and the effects are small. Meanwhile, when the REM content is greater than 0.0500%, a hard REM oxysulfide ($REM_2O_2S$) is excessively formed, and fatigue cracks initiate due to stress concentration such that the internal fatigue damage resistance may deteriorate. Therefore, it is preferable that the REM content is set to be in a range of 0.0005% to 0.0500% when REM is included.

Further, REM is rare earth metals such as Ce, La, Pr, or Nd. The REM content is the total amount of all the REM elements. When the total amount is in the above-described range, the same effects can be obtained even when the form is either of a single element or a combination of elements (two or more kinds).

Zr: Preferably 0.0001% to 0.0200%

Zr is bonded to O to form a $ZrO_2$ inclusion. Since this $ZrO_2$ inclusion has excellent lattice matching performance with γ-Fe, the $ZrO_2$ inclusion serves as a solidified nucleus of high carbon rail steel in which γ-Fe is a solidified primary phase and suppresses formation of a segregation zone in a cast piece center portion by increasing the equiaxed crystal ratio of a solidification structure. In addition, Zr is an element which suppresses formation of a martensite structure in a segregation portion of the rail by suppressing formation of a segregation zone in a cast piece center portion. However, when the Zr content is less than 0.0001%, the number of $ZrO_2$-based inclusions formed is small, and the inclusions do not sufficiently exhibit the effects as solidified nuclei. On the other hand, when the Zr content is greater than 0.0200%, a large amount of coarse Zr-based inclusions are formed, and fatigue cracks initiate due to stress concentration such that the internal fatigue damage resistance of the rail may deteriorate. Therefore, it is preferable that the Zr content is set to be in a range of 0.0001% to 0.0200% when Zr is included.

Al: Preferably 0.0100% to 1.00%

Al is an element which functions as a deoxidation material. Further, Al is an element which shifts the eutectoid transformation temperature to a high temperature side, contributes to an increase in the hardness (strength) of the pearlite structure, and thus improves the wear resistance or the internal fatigue damage resistance of the pearlite structure. However, when the Al content is less than 0.0100%, the effects are small. On the other hand, when the Al content is greater than 1.00%, it is difficult to solid-solubilize Al in the steel, and a coarse alumina-based inclusion is formed. Since the coarse Al-based inclusion functions as the origin of fatigue cracks, the internal fatigue damage resistance of the rail may deteriorate. Further, when the Al content is greater than 1.00%, an oxide is formed during welding, and weldability may deteriorate significantly. Therefore, it is preferable that the Al content is set to be in a range of 0.0100% to 1.00% when Al is included.

In the rail according to the embodiment, the alloy component of rail steel, the structure, the hardness of the surface or the inside of the head portion, and the number density of the fine V nitride including Cr are controlled, and the composition of the V nitride including Cr is controlled. As a result, for use in cargo railways, the wear resistance and the internal fatigue damage resistance of the rail are improved, and the service life can be significantly improved.

Next, a preferable method of manufacturing the rail according to the embodiment will be described.

When the rail according to the embodiment includes the above-described elements, the structures, and the like, the effects can be obtained irrespective the manufacturing method. However, the manufacturing method including the following processes is preferable because the rail according to the embodiment is stably obtained.

In the method of manufacturing the rail according to the embodiment, the rail can be obtained by heating a bloom including the chemical composition of the rail according to the embodiment, hot-rolling the heated bloom to form a rail, and performing accelerated cooling and controlled cooling on the rail. Preferable manufacturing conditions are as shown in the following table, and specific reasons thereof will be described below. The final rolling reduction is a reduction of area in the rail head portion. In addition, the temperature (other than the bloom temperature) shown as a heat treatment condition refers to the temperature of the outer surface of the rail head portion. In the rail according to the embodiment, it is necessary to control the structure of the range from the outer surface of the head portion as the origin to a depth of 25 mm, the hardness, and the V nitride including Cr at the position from the outer surface of the head portion as the origin to a depth of 25 mm, and the configuration of other positions is not particularly limited. Therefore, heat treatment conditions are also determined for the outer surface of the head portion.

TABLE 1

| | |
|---|---|
| Heating rate of bloom | 1 to 8° C./min in a range of 1000° C. to 1200° C. |
| Heating finish temperature of bloom | 1200° C. or higher |
| Finish rolling temperature | 850° C. to 1000° C. |
| Final rolling reduction (reduction of area in rail head portion) | 2% to 20% |
| Start temperature of the accelerated cooling | 750° C. or higher |
| Average cooling rate of the accelerated cooling | 2 to 30° C./sec |

TABLE 1-continued

| | |
|---|---|
| End temperature of the accelerated cooling | 580° C. to 660° C. |
| Retention temperature at controlled cooling | Range of 580° C. to 660° C. |
| Fluctuation of the rail surface temperature at retention of temperature at controlled cooling | 60° C. or lower |
| Temperature holding time at controlled cooling | 5 to 150 sec |
| Cooling after retention of temperature at controlled cooling | air cooling or accelerated cooling |

The rail according to the present embodiment can be manufactured by melting raw materials in a typically used melting furnace such as a converter or an electric furnace to obtain molten steel having the adjusted composition, casting the molten steel using an ingot-making and blooming method or a continuous casting method to obtain a bloom (bloom or slab), reheating and hot-rolling the bloom to form the bloom in a rail shape, and performing a heat treatment after hot rolling. The chemical composition of the bloom may be in the same range as that of the chemical composition of the above-described rail according to the embodiment.

In order to control the number density and the grain size of the V nitride including Cr through the series of processes, it is necessary to control heating conditions during bloom heating before rolling and to control heat treatment conditions after rolling. In addition, in order to control the hardness or the structure of the rail head portion, it is necessary to control rolling conditions of the rail and heat treatment conditions after rolling.

First, the control the heating conditions during bloom heating before rolling will be described. The process of heating the bloom is most important in order to stably form the fine V nitride including Cr through the rail heat treatment. Since controlled cooling is not performed during manufacturing of the bloom, the V nitride including Cr is coarsened in the stage of the bloom. Accordingly, in order to stably form the fine V nitride including Cr after the rail heat treatment, it is necessary to redissolve the coarsened V nitride including Cr in the bloom before rolling. Therefore, in a temperature range (1000° C. to 1200° C.) in which the V nitride including Cr is redissolved, it is necessary to control bloom heating conditions.

The bloom heating conditions are preferably as follows.

Heating rate: 1 to 8° C./min

Speed-controlled temperature range: 1000° C. to 1200° C.

The above-described temperature is a temperature condition of the bloom, and it is preferable that the temperature of a heating furnace is controlled to satisfy the above-described heating conditions. In addition, it should be noted that the heating rate of the bloom before hot rolling is not the average heating rate. That is, the heating rate is a gradual heating rate during heating. In the method of manufacturing the rail according to the embodiment, it is necessary to set the temperature rising rate to 1 to 8° C./min constantly while the temperature of the bloom increases from 1000° C. to 1200° C. In other words, when a relationship between the temperature T [° C.] of the bloom and the time t [min] is defined as T(t), in the method of manufacturing the rail according to the embodiment, it is necessary to set dT(t)/dt [° C./min] to 1 to 8 constantly while the temperature of the bloom increases from 1000° C. to 1200° C.

First, the reason why it is preferable that the heating rate of the bloom is in a range of 1 to 8° C./min will be described.

When the heating rate is slower than 1° C./min, the V nitride including Cr coarsened during casting is redissolved. In this case, the V nitride including Cr precipitates again during heating and is coarsened. Therefore, it is difficult to dissolve the V nitride including Cr, and it may be difficult to stably form the fine V nitride including Cr during the rail heat treatment. Further, when the heating rate is slower than 1° C./min, the heating of the bloom is excessive, and cracks initiate in the bloom as the decarburization of the bloom surface progresses. Therefore, there may be a case where the quality of a rail product after hot rolling and the heat treatment cannot be ensured. In addition, when the heating rate is slower than 1° C./min, a large amount of a heating fuel is used, and thus the economic efficiency may deteriorate.

On the other hand, when the heating rate is faster than 8° C./min, it is difficult to redissolve the V nitride including Cr coarsened during casting, and the coarsened V nitride including Cr remains. Further, it may be difficult to stably form the fine V nitride including Cr during the rail heat treatment. Therefore, it is preferable that the heating rate is in a range of 1 to 8° C./min. The heating rate may be 2° C./min or faster or 3° C./min or faster. The heating rate may be 7° C./min or slower, 6° C./min or slower, or 5° C./min or slower.

As described above, the heating rate is a gradual heating rate during bloom heating. By controlling the gradual heating rate of the bloom to the above-described range, the fine V nitride including Cr can be stably formed through the heat treatment of the rail obtained by hot-rolling the bloom. The heating rate after the bloom temperature exceeds 1200° C. is not particularly limited. In addition, the temperature (heating finish temperature) at which the heating of the bloom is stopped can be any value of 1200° C. or higher. The heating finish temperature of the bloom may be 1220° C. or higher, 1250° C. or higher, or 1300° C. or higher.

Next, the control of the rolling conditions of the rail and the heat treatment conditions after rolling will be described. In order to control the hardness or the structure of the rail head portion, it is necessary to control the rolling conditions and the heat treatment conditions after rolling. In addition, in order to control the number density and the grain size of the V nitride including Cr, it is necessary to control the heat treatment conditions after rolling. It is preferable that the rolling conditions and the heat treatment conditions after rolling are performed in the following condition range. Accelerated cooling refers to cooling that is performed by spraying a cooling medium such as water or the like on the rail surface. The start time and the end time of accelerated cooling is the start time and the end time of spraying of the cooling medium. In addition, the cooling rate during accelerated cooling refers to the average cooling rate, and specifically is a value obtained by dividing a difference between the rail surface temperatures at the start time and the end time of accelerated cooling by the elapsed time between the start time and the end time of accelerated cooling.

Hot Rolling Conditions

Finish rolling temperature of outer surface of head portion: 850° C. to 1000° C.

Final rolling reduction of head portion cross section (reduction of area in rail head portion): 2 to 20%

Heat Treatment Conditions after Hot Rolling (Outer Surface of Head Portion): Accelerated Cooling and Controlled Cooling are Performed after Rolling Accelerated cooling (outer surface of head portion)

Average cooling rate: 2 to 30° C./sec

Accelerated cooling start temperature: 750° C. or higher

Accelerated cooling stop temperature: 580° C. to 660° C.

Controlled Cooling (Outer Surface of Head Portion)

The temperature of the outer surface of the head portion is retained in a range of 580° C. to 660° C. for 5 to 150 seconds after stopping accelerated cooling, and subsequently air cooling and accelerated cooling are performed.

Retention at temperature: the temperature is controlled by controlling the accelerated cooling rate, repeating the execution and the stop of accelerated cooling, and performing accelerated cooling according to reheat from the inside of the rail.

When the ratio of the number of Cr atoms (CA) to the number of V atoms (VA) in the V nitride including Cr is controlled to prevent initiation of fine cracks around the nitride, it is preferable that the accelerated cooling conditions and the controlled cooling conditions described above are changed to the following conditions.

Accelerated Cooling (Outer Surface of Head Portion)

Average cooling rate: 2 to 30° C./sec

Accelerated cooling start temperature: 750° C. or higher

Accelerated cooling stop temperature: 600° C. to 650° C.

Controlled Cooling (Outer Surface of Head Portion)

The temperature of the outer surface of the head portion is retained in a range of 600° C. to 650° C. for 20 to 150 seconds after stopping accelerated cooling, and subsequently air cooling and accelerated cooling are performed.

Retention at temperature during controlled cooling: the temperature is controlled to a predetermined temperature range by controlling the accelerated cooling rate, repeating the execution and the stop of accelerated cooling according to reheat from the inside of the rail.

First, the reason why it is preferable that the finish rolling temperature (outer surface of the head portion) during hot rolling is set to be in a range of 850° C. to 1000° C. will be described.

When the finish rolling temperature (outer surface of the head portion) is lower than 850° C., refinement of austenite grains after rolling is significant. In this case, the hardenability deteriorates significantly, and it may be difficult to ensure the hardness of the rail head portion. Further, when the finish rolling temperature (outer surface of the head portion) is higher than 1000° C., austenite grains after rolling become coarse, the hardenability is excessively increased, and the bainite structure harmful to the wear resistance is easily generated in the rail head portion. Therefore, it is preferable that the finish rolling temperature (outer surface of the head portion) is set to be in a range of 850° C. to 1000° C. The finish rolling temperature may be 860° C. or higher, 880° C. or higher, or 900° C. or higher. The finish rolling temperature may be 980° C. or lower, 960° C. or lower, or 940° C. or lower.

Next, the reason why it is preferable that the final rolling reduction (reduction of area) of hot rolling is set to be in a range of 2% to 20% will be described.

When the final rolling reduction (reduction of area in the rail head portion) is less than 2%, austenite grains after rolling are coarsened, the hardenability is excessively increased, a bainite structure harmful to the wear resistance is likely to be formed in the rail head portion, the grain size of the pearlite structure increases, and there may be a case where the ductility or the toughness required for the rail cannot be ensured. On the other hand, when the final rolling reduction (reduction of area in the rail head portion) is greater than 20%, refinement of austenite grains after rolling is significant, the hardenability deteriorates significantly, and it is difficult to ensure the hardness of the rail head portion. Therefore, it is preferable that the final rolling reduction (reduction of area in the rail head portion) is set to be in a range of 2% to 20%. The final rolling reduction (reduction of area in the rail head portion) may be 4% or greater, 6% or greater, or 8% or greater. The final rolling reduction (reduction of area in the rail head portion) may be 18% or less, 16% or less, or 14% or less.

As long as the above-described conditions are satisfied, other rolling conditions of the rail head portion are not particularly limited. In order to ensure the hardness of the rail head portion, the finish rolling temperature through groove rolling of a typical rail only has to be controlled. As a rolling method, for example, a method described in Japanese Unexamined Patent Application, First Publication No. 2002-226915 may be used such that the pearlite structure is mainly obtained. That is, after performing rough rolling on the bloom, intermediate rolling is performed in a plurality of passes using a reverse mill, and then finish rolling is performed in two or more passes using a continuous mill. The finish rolling temperature during finish rolling may be controlled to the above-described temperature range.

Next, the reason why it is preferable that the average cooling rate of accelerated cooling (outer surface of the head portion) is set to be in a range of 2° C./sec to 30° C./sec.

When the average cooling rate is slower than 2° C./sec, the pearlitic transformation starts in a high temperature range during the accelerated cooling. As a result, in the component system of the rail according to the embodiment, a portion having a hardness of less than Hv 360 is formed on the surface of the rail head portion, and it may be difficult to ensure the wear resistance or the internal fatigue damage resistance required for the rail. On the other hand, when the average cooling rate is faster than 30° C./sec, in the component system of the rail according to the embodiment, the hardness of the pearlite structure increases significantly. Further, a bainite structure or a martensite structure is formed on the surface of the rail head portion, and deterioration in the wear resistance or the toughness of the rail is concerned. Therefore, it is preferable that the average cooling rate during accelerated cooling is set to be in a range of 2° C./sec to 30° C./sec. The average cooling rate during accelerated cooling may be 3° C./sec or faster, 4° C./sec or faster, or 5° C./sec or faster. The average cooling rate during accelerated cooling may be 25° C./sec or slower, 20° C./sec or slower, or 15° C./sec or slower.

Next, the reason why it is preferable that the start temperature of accelerated cooling (that is, the rail temperature at which spraying of the cooling medium starts) is set to 750° C. or higher and the end temperature of accelerated cooling (that is, the rail temperature at which spraying of the cooling medium stops) is set to be in a range of 580° C. to 660° C. will be described.

When the start temperature of accelerated cooling of the outer surface of the head portion is lower than 7500, the pearlite structure is occasionally generated in a high temperature range before accelerated cooling. In this case, a predetermined hardness cannot be obtained, and it is difficult to ensure the wear resistance or the surface damage resistance required for the rail. Further, in this case, in steel having a relatively large amount of carbon, there is a concern that a pro-eutectoid cementite structure is formed, the pearlite structure is embrittled, and the toughness of the rail deteriorates. Therefore, it is preferable that the temperature of the outer surface of the rail head portion at the start of accelerated cooling is set to 750° C. or higher. In order to set the start temperature of accelerated cooling to 750° C. or higher in consideration of the above-described finish rolling temperature, it is presumed that the accelerated cooling is required to start within 180 seconds after completion of hot rolling.

In addition, when the stop temperature of accelerated cooling is higher than 660° C., the pearlitic transformation starts in a high temperature range immediately after cooling, and a large amount of the pearlite structure having a low hardness is formed. As a result, the hardness of the surface of the rail head portion cannot be ensured, and it may be difficult to ensure the wear resistance or the surface damage resistance required for the rail. On the other hand, when the stop temperature of accelerated cooling is lower than 580° C., a large amount of a bainite structure harmful to the wear resistance is formed on the surface of the rail head portion immediately after cooling, and it may be difficult to ensure the wear resistance required for the rail. Therefore, it is preferable that the stop temperature of accelerated cooling is set to be in a range of 580° C. to 660° C.

The cooling medium for the heat treatment of the rail head portion during accelerated cooling is not particularly limited. In order to control the hardness to a predetermined range so as to impart the wear resistance and the internal fatigue damage resistance to the rail, it is preferable to control the cooling rate of the rail head portion during the heat treatment using air injection cooling, mist cooling, mixed injection cooling of water and air, or a combination thereof.

Next, the reason for limiting the preferable conditions for controlled cooling that is performed after accelerated cooling will be described. This process largely affects the number density and the grain size of the V nitride including Cr. In the method of manufacturing the rail according to the embodiment, during controlled cooling, the temperature of the rail decreases after being retained in a predetermined range for a predetermined time by spraying the cooling medium according to the degree of reheat. That is, the controlled cooling process can also be called a combination of the temperature retention process and the next cooling process.

An example of the configuration of controlled cooling will be described below. In the method of manufacturing the rail according to the embodiment, first, the above-described accelerated cooling ends. The end time of the accelerated cooling is the start time of temperature retention during controlled cooling. After stopping accelerated cooling, reheat is generated in the rail, and the surface temperature of the rail typically increases. The surface temperature of the rail increases to some extent due to the reheat, and subsequently decreases again when the cooling medium is sprayed to the rail. The surface temperature of the rail decreases to some extent due to the spraying of the cooling medium, and subsequently increases again when the spraying of the cooling medium to the rail is stopped. That is, the temperature retention during the controlled cooling of the rail is typically achieved by repeating the temperature increase by reheat and temperature decrease by cooling. This way, it is preferable that accelerated cooling is stopped on a low temperature side in a temperature range where the temperature is retained, cooling is started after observing the reheat generated from the inside of the rail head portion, and cooling is stopped before the temperature reaches the lower limit of a predetermined temperature range. Further, it is preferable that this temperature control is repeatedly performed to control the holding time. When the amount of reheat is small, it is also effective to perform heating using an IH coil or the like. However, the degree of reheat is small, and even when the cooling medium is not sprayed, temperature fluctuation on the rail surface may be maintained within a given range. In this case, the temperature can be retained simply by leaving the rail to stand. During the temperature retention of the controlled cooling, it is preferable that the temperature of the rail surface is in a range of 580° C. to 660° C., it is preferable that the fluctuation of the rail surface temperature is within 60° C., and it is preferable that the temperature holding time is in a range of 5 to 150 sec.

First, the reason why it is preferable that the retention temperature after accelerated cooling is in a range of 580° C. to 660° C. and the fluctuation of the rail surface temperature is within 60° C. will be described.

When the retention temperature is higher than 660° C., in the component system of the rail according to the present embodiment, the pearlitic transformation starts in a high temperature range immediately after cooling, and a large amount of the pearlite structure having a low hardness is formed on the surface of the rail head portion. As a result, the hardness cannot be ensured, and it is difficult to ensure the wear resistance or the surface damage resistance required for the rail. Further, in this case, the formation of the V nitride including Cr in the rail head portion is promoted, and the number density increases excessively. As a result, the pearlite structure in the rail head portion is embrittled, the initiation of cracks is promoted, and the internal fatigue damage resistance may deteriorate.

On the other hand, when the retention temperature is lower than 580° C., a large amount of a bainite structure harmful to the wear resistance is formed on the surface of the rail head portion. As a result, it may be difficult to ensure the wear resistance required for the rail. Further, in this case, the formation of the V nitride including Cr in the rail head portion is suppressed, and the number density decreases. As a result, the improvement of the microscopic softening in ferrite of the pearlite structure is not sufficient, and the improvement of the internal fatigue damage resistance of the rail is not recognized. Therefore, it is preferable that the retention temperature after accelerated cooling is set to be in a range of 580° C. to 660° C.

When the fluctuation of the rail surface temperature exceeds 60° C., the macroscopic hardness of the pearlite structure on the surface of the rail head portion is inhomogeneous. As a result, it may be difficult to ensure the wear resistance and the internal fatigue damage resistance required for the rail. Therefore, it is preferable that the fluctuation of the rail surface temperature is within 60° C.

Next, the reason why it is preferable that the holding time is in a range of 5 to 150 sec will be described. When the temperature is retained by a combination of reheat and spraying of cooling medium, the holding time refers to the period of time from the end of the accelerated cooling to the end of the final reheat (the time when the rail temperature starts to decrease naturally or the start time of spraying of the cooling medium). When the temperature is retained only by reheat or transformation heating, the holding time refers to the period of time from the end of the accelerated cooling to the end of reheat or transformation heating (the time when the rail temperature starts to decrease naturally or the start time of spraying of the cooling medium).

When the holding time is longer than 150 sec, tempering of the pearlite structure progresses during the retention, and the pearlite structure is softened. As a result, the hardness of the surface and the inside of the rail head portion cannot be ensured, and it is difficult to ensure the wear resistance or the internal fatigue damage resistance required for the rail.

Further, in this case, in the rail head portion, the V nitride including Cr grows, and the grain size thereof increases. As a result, the number density of the fine V nitride including Cr decreases, and the improvement of microscopic softening in ferrite of the pearlite structure cannot be expected.

On the other hand, when the holding time is shorter than 5 sec, the pearlitic transformation is not completed during retention, and a martensite structure is formed. As a result, it is difficult to ensure the wear resistance or the internal fatigue damage resistance of the surface and the inside of the rail head portion. In addition, in this case, the growth of the V nitride including Cr is suppressed, and the grain size thereof decreases. As a result, the number density of the fine V nitride including Cr decreases, the microscopic softening in ferrite of the pearlite structure is not improved, and the improvement of the internal fatigue damage resistance cannot be expected. Therefore, it is preferable that the time of retaining the temperature after accelerated cooling is 5 to 150 sec.

The method of retaining the temperature during controlled cooling is not particularly limited. It is preferable to perform cooling that controls reheat generated from the inside of the rail head portion by repeatedly performing the cooling and stopping of the outer surface of the rail head portion using air injection cooling, mist cooling, mixed injection cooling of water and air, or a cooling medium obtained by combining these.

When the number of V nitrides having a grain size of 0.5 to 4.0 nm and including Cr and CA/VA are controlled, the reason why it is preferable that the retention temperature is in a range of 600° C. to 650° C. and the holding time is in a range of 20 to 120 sec during the controlled cooling will be described.

When the retention temperature is lower than 600° C., the number of Cr atoms in the V nitride including Cr increases, CA/VA increases, and it is difficult to satisfy the predetermined CA/VA value. As a result, it is difficult to prevent the initiation of fine cracks around the V nitride including Cr. On the other hand, when the retention temperature is higher than 650° C., the number of V atoms in the V nitride including Cr increases, and it is difficult to stably maintain the CA/VA value. Therefore, it is preferable that the retention temperature is in a range of 600° C. to 650° C.

When the holding time is shorter than 20 sec, the number of Cr atoms in the V nitride including Cr increases, CA/VA increases, and it is difficult to satisfy the predetermined CA/VA value. As a result, it is difficult to prevent the initiation of fine cracks around the V nitride including Cr. On the other hand, when the holding time is longer than 120 sec, the number of V atoms in the V nitride including Cr increases, CA/VA decreases, and it is difficult to satisfy the predetermined CA/VA value. As a result, it is difficult to prevent the initiation of fine cracks around the V nitride including Cr. Therefore, it is preferable that the holding time is in a range of 20 to 120 sec.

After the temperature retention, air cooling and accelerated cooling are performed on the rail. When the cooling rate of the rail after temperature retention is excessively slow, as in the case where the temperature is retained for a long time, tempering of the pearlite structure progresses during the retention, and there are a concern that where the hardness of the surface and the inside of the rail head portion cannot be secured and a concern that the number density of the fine V nitride including Cr decrease. Accordingly, it is presumed that, in order to prevent these problems, a cooling rate of 0.5° C./sec or faster is required to be maintained until the temperature reaches at least about 200° C. This cooling condition can be satisfied by leaving the rail to stand in air at normal temperature or performing accelerated cooling on the rail after the temperature retention.

Examples

In order to verify the effects of the present invention, an experiment was performed in the following procedure.

Each of blooms having chemical compositions shown in Tables 2-1 to 2-4 was heated, the heated bloom was hot-rolled to form a rail, and accelerated cooling and controlled cooling were performed on the rail. As a result, a rail having a metallographic structure, a hardness, and V nitride including Cr shown in Tables 3-1 to 3-4 was obtained. In these tables, values outside of the range of the present invention are underlined. Manufacturing conditions are as follows unless specified otherwise in the column "Note" in the tables.

Heating rate of bloom: 4° C./min in a range of 1000° C. to 1200° C.

End temperature of heating of bloom: 1250° C.

Finish rolling temperature: 950° C.

Final rolling reduction (reduction of area): 5% to 10%

Start temperature of accelerated cooling: 800° C.

Average cooling rate during accelerated cooling: 6 to 8° C./sec

End temperature during accelerated cooling: 600° C.

Retention temperature during controlled cooling: 600° C. to 660° C.

Temperature holding time during controlled cooling: 20 to 40 sec

Cooling after end of temperature retention: the rail was cooled to room temperature by leaving the rail stand in air at a normal temperature On the other hand, rails described below were manufactured under the following manufacturing conditions as described in the column "Note" in the table.

In No. 49, the end temperature during accelerated cooling was 560° C., but other conditions were as described above.

In No. 50, the average cooling rate during accelerated cooling was 35.0° C./sec, but other conditions were as described above.

In No. 53, the average cooling rate during accelerated cooling was 1.0° C./sec, but other conditions were as described above.

In No. 54, the end temperature during accelerated cooling was 680° C., but other conditions were as described above.

In No. 57, the heating rate of the bloom in a range of 1000° C. to 1100° C. was 10° C./min, but the heating rate of the bloom in a range of 1100° C. to 1200° C. was 5° C./min and other conditions were as described above.

In No. 58, the heating rate of the bloom in a range of 1100° C. to 1200° C. was 12° C./min, but the heating rate of the bloom in a range of 1000° C. to 1100° C. was 6° C./min and other conditions were as described above.

In No. 59, the heating rate of the bloom in a range of 1000° C. to 1100° C. was 0.5° C./min, but the heating rate of the bloom in a range of 1100° C. to 1200° C. was 4° C./min and other conditions were as described above.

In No. 60, the heating rate of the bloom in a range of 1100° C. to 1200° C. was 0.8° C./min, but the heating rate of the bloom in a range of 1000° C. to 1100° C. was 3° C./min and other conditions were as described above.

In No. 61, the heating rate of the bloom in a range of 1000° C. to 1200° C. was 10.0° C./min, but other conditions were as described above.

In No. 79, the heating rate of the bloom in a range of 1000° C. to 1200° C. was 8.0° C./min, but other conditions were as described above. In No. 80, the heating rate of the bloom in a range of 1000° C. to 1200° C. was 6.0° C./min, but other conditions were as described above.

In No. 81, the heating rate of the bloom in a range of 1000° C. to 1200° C. was 5.0° C./min, but other conditions were as described above.

In No. 82, the heating rate of the bloom in a range of 1000° C. to 1200° C. was 3.0° C./min, but other conditions were as described above.

In No. 83, the heating rate of the bloom in a range of 1000° C. to 1200° C. was 2.0° C./min, but other conditions were as described above.

For the rails obtained in the above-described procedure, (1) the area ratio of the pearlite structure (the surface pearlite area ratio and the 25 mm position pearlite area ratio), (2) the hardness (the surface hardness and the 25 mm position hardness), (3) the state of the precipitate (the number density of the V nitride having a grain size of 0.5 to 4.0 nm and including Cr and CA/VA), and (4) the characteristics (the internal fatigue damage resistance and the wear resistance) were evaluated by the following procedure.

(1) The area ratio of the pearlite structure was measured by cutting a sample out from a transverse cross section of each of the rail head portions, performing 3% nital etching treatment on each of the samples after polishing the sample with a diamond grit, and observing the structure with an optical microscope (200-fold). In the measurement, 10 visual fields from the outer surface of the head portion to a depth of 2 mm were selected, and 10 visual fields from the outer surface of the head portion to a depth of 25 mm were selected. The average value of the area ratios of the pearlite structures in the 10 visual fields from the outer surface of the head portion to a depth of 2 mm was adopted as "surface pearlite area ratio", and the average value of the area ratios of the pearlite structures in the 10 visual fields from the outer surface of the head portion to a depth of 25 mm was adopted as "25 mm position pearlite area ratio". When both the ratios of the rail were 95 area % or greater, it was determined that the structure ranging from the outer surface of the head portion as the origin to a depth of 25 mm includes 95% or greater of the pearlite structure by area ratio.

(2) The hardness was obtained by cutting a sample out from a transverse cross section of each of the rail head portions, polishing a portion of each of the samples corresponding to the rail transverse cross section with a diamond grit having an average grain size of 1 μm, and measuring the hardness using a Vickers hardness meter (load: 98 N) according to JIS Z 2244. The hardness was measured at 20 points at any position of a depth of 2 mm from the outer surface of the head portion, and the average value thereof was adopted as the surface hardness. The hardness was measured at 20 points at any position of a depth of 25 mm from the outer surface of the head portion, and the average value thereof was adopted as the 25 mm position hardness. When both the hardness values of the rail were in a range of Hv 360 to 500, it was determined that the hardness of the structure in the range from the outer surface of the head portion as the origin to a depth of 25 mm was in a range of Hv 360 to 500.

(3) The state of the inclusion was obtained by collecting some needle samples having a curvature radius of 30 to 80 nm using a focused ion beam (FIB) method from ferrite of the pearlite structure at several positions ranging from the outer surface of the head portion as the origin to a depth of 25 mm, and evaluating these samples using a three-dimensional atom probe (3DAP) method. The details of the evaluation conditions are as described above. In the needle samples obtained as described above, the average value of the number density of the V nitride having a grain size of 0.5 to 4.0 nm and including Cr in the ferrite of the pearlite structure at a position at a depth of 25 mm from the outer surface of the head portion as the origin was adopted as "Number density of Cr-Containing V Nitride", and the average value of the ratio of CA to VA (the average value of the values in the needle samples) in the V nitride having a grain size of 0.5 to 4.0 nm and including Cr in the ferrite of the pearlite structure at a position at a depth of 25 mm from the outer surface of the head portion as the origin was adopted as "CA/VA".

(4) The characteristics of the rail were evaluated using a rolling fatigue tester shown in FIG. 2. Regarding the shape of the test piece, a rail having a length of 2 m and a weight of 141 lbs was used, an AAR type (diameter: 920 mm) was used as wheels in contact with the rail, and the loads applied to the wheels were load: 275 to 325 KN and thrust: 50 to 80 KN. A lubricant was not used in the evaluation of the wear resistance, and an oil lubricant was used in the evaluation of the internal fatigue damage resistance.

In the evaluation of the wear resistance, the above-described test was performed five times until the wear amount of the rail head surface layer portion exceeded 25 mm, and the average value of the cumulative passing tonnage accumulated until the wear amount exceeded 25 mm was adopted as an index representing the wear resistance of the rail. The evaluation criteria were as follows. The rail determined as one of the ranks A to C among the evaluation criteria was determined to have excellent wear resistance.

A: when the wear amount reached 25 mm, the cumulative passing tonnage was greater than 175 and 200 MGT or less.

B: when the wear amount reached 25 mm, the cumulative passing tonnage was greater than 150 and 175 MGT or less.

C: when the wear amount reached 25 mm, the cumulative passing tonnage was greater than 100 and 150 MGT or less.

X: when the wear amount reached 25 mm, the cumulative passing tonnage was less than 100 MGT.

In the evaluation of the internal fatigue damage resistance, using an ultrasonic flaw detector, whether or not cracks were formed in the head portion, a crack having a length of 2 mm or longer was determined as a flaw, and the above-described test was performed 5 times until the crack was formed. When the flaw was not formed, the test was stopped at 200 MGT (Million Gross Tonnage), and the cumulative passing tonnage accumulated until the flaw was generated was considered as 200 MGT. The average value of the cumulative passing tonnage accumulated until the flaw was generated was adopted as an index in the evaluation of the internal fatigue damage resistance of the rail. The evaluation criteria were as follows. The rail determined as one of the ranks A to C among the evaluation criteria was determined to have excellent internal fatigue damage resistance.

A: when the flaw was generated, the cumulative passing tonnage was greater than 175 and 200 MGT or less.

B: when the flaw was generated, the cumulative passing tonnage was greater than 150 and 175 MGT or less.

C: when the flaw was generated, the cumulative passing tonnage was greater than 100 and 150 MGT or less.

X: when the flaw was generated, the cumulative passing tonnage was less than 100 MGT.

TABLE 2-1

| | | C | Si | Mn | Cr | V | N | P | S | Mo | Co | B | Cu | Ni | Nb | Ti | Mg | Ca | REM | Zr | Al |
|---|---|---|---|---|---|---|---|---|---|---|---|---|---|---|---|---|---|---|---|---|---|
| 1 | Example | 1.00 | 0.50 | 0.80 | 0.30 | 0.05 | 0.0120 | 0.012 | 0.012 | — | — | — | — | — | — | — | — | — | — | — | — |
| 2 | Comparative Example | 1.35 | 0.50 | 0.80 | 0.30 | 0.05 | 0.0120 | 0.012 | 0.012 | — | — | — | — | — | — | — | — | — | — | — | — |
| 3 | Example | 1.20 | 0.50 | 0.80 | 0.30 | 0.05 | 0.0120 | 0.012 | 0.012 | — | — | — | — | — | — | — | — | — | — | — | — |
| 4 | Example | 1.05 | 0.50 | 0.70 | 0.35 | 0.05 | 0.0120 | 0.012 | 0.012 | — | — | — | — | — | — | — | — | — | — | — | — |
| 5 | Example | 0.90 | 0.50 | 0.70 | 0.35 | 0.05 | 0.0120 | 0.012 | 0.012 | — | — | — | — | — | — | — | — | — | — | — | — |
| 6 | Example | 0.75 | 0.50 | 0.80 | 0.30 | 0.05 | 0.0120 | 0.012 | 0.012 | — | — | — | — | — | — | — | — | — | — | — | — |
| 7 | Comparative Example | 0.70 | 0.50 | 0.80 | 0.30 | 0.05 | 0.0120 | 0.012 | 0.012 | — | — | — | — | — | — | — | — | — | — | — | — |
| 8 | Comparative Example | 1.00 | 2.30 | 0.80 | 0.30 | 0.05 | 0.0120 | 0.012 | 0.012 | — | — | — | — | — | — | — | — | — | — | — | — |
| 9 | Example | 1.00 | 2.00 | 0.80 | 0.30 | 0.05 | 0.0120 | 0.012 | 0.012 | — | — | — | — | — | — | — | — | — | — | — | — |
| 10 | Example | 1.10 | 1.00 | 0.60 | 0.40 | 0.05 | 0.0120 | 0.012 | 0.012 | — | — | — | — | — | — | — | — | — | — | — | — |
| 11 | Example | 1.10 | 0.50 | 0.60 | 0.40 | 0.05 | 0.0120 | 0.012 | 0.012 | — | — | — | — | — | — | — | — | — | — | — | — |
| 12 | Example | 1.00 | 0.10 | 0.80 | 0.30 | 0.05 | 0.0120 | 0.012 | 0.012 | — | — | — | — | — | — | — | — | — | — | — | — |
| 13 | Comparative Example | 1.00 | 0.05 | 0.80 | 0.30 | 0.05 | 0.0120 | 0.012 | 0.012 | — | — | — | — | — | — | — | — | — | — | — | — |
| 14 | Comparative Example | 1.00 | 0.50 | 2.50 | 0.30 | 0.05 | 0.0120 | 0.012 | 0.012 | — | — | — | — | — | — | — | — | — | — | — | — |
| 15 | Example | 1.00 | 0.50 | 2.00 | 0.30 | 0.05 | 0.0120 | 0.012 | 0.012 | — | — | — | — | — | — | — | — | — | — | — | — |
| 16 | Example | 0.95 | 0.80 | 1.10 | 0.50 | 0.05 | 0.0120 | 0.012 | 0.012 | — | — | — | — | — | — | — | — | — | — | — | — |
| 17 | Example | 0.95 | 0.80 | 0.55 | 0.50 | 0.05 | 0.0120 | 0.012 | 0.012 | — | — | — | — | — | — | — | — | — | — | — | — |
| 18 | Example | 1.00 | 0.50 | 0.10 | 0.30 | 0.05 | 0.0120 | 0.012 | 0.012 | — | — | — | — | — | — | — | — | — | — | — | — |
| 19 | Comparative Example | 1.00 | 0.50 | 0.05 | 0.30 | 0.05 | 0.0120 | 0.012 | 0.012 | — | — | — | — | — | — | — | — | — | — | — | — |
| 20 | Comparative Example | 1.00 | 0.50 | 0.80 | 1.50 | 0.05 | 0.0120 | 0.012 | 0.012 | — | — | — | — | — | — | — | — | — | — | — | — |
| 21 | Example | 1.00 | 0.50 | 0.80 | 1.20 | 0.05 | 0.0120 | 0.012 | 0.012 | — | — | — | — | — | — | — | — | — | — | — | — |

TABLE 2-2

| | | C | Si | Mn | Cr | V | N | P | S | Mo | Co | B | Cu | Ni | Nb | Ti | Mg | Ca | REM | Zr | Al |
|---|---|---|---|---|---|---|---|---|---|---|---|---|---|---|---|---|---|---|---|---|---|
| 22 | Example | 0.85 | 0.50 | 0.60 | 0.85 | 0.05 | 0.0120 | 0.012 | 0.012 | — | — | — | — | — | — | — | — | — | — | — | — |
| 23 | Example | 0.85 | 0.50 | 0.60 | 0.55 | 0.05 | 0.0120 | 0.012 | 0.012 | — | — | — | — | — | — | — | — | — | — | — | — |
| 24 | Example | 1.00 | 0.50 | 0.80 | 0.10 | 0.05 | 0.0120 | 0.012 | 0.012 | — | — | — | — | — | — | — | — | — | — | — | — |
| 25 | Comparative Example | 1.00 | 0.50 | 0.80 | 0.05 | 0.05 | 0.0120 | 0.012 | 0.012 | — | — | — | — | — | — | — | — | — | — | — | — |
| 26 | Comparative Example | 1.00 | 0.50 | 0.80 | 0.30 | 0.30 | 0.0120 | 0.012 | 0.012 | — | — | — | — | — | — | — | — | — | — | — | — |
| 27 | Example | 1.00 | 0.50 | 0.80 | 0.30 | 0.19 | 0.0120 | 0.012 | 0.012 | — | — | — | — | — | — | — | — | — | — | — | — |
| 28 | Example | 1.00 | 0.50 | 0.80 | 0.30 | 0.15 | 0.0120 | 0.012 | 0.012 | — | — | — | — | — | — | — | — | — | — | — | — |
| 29 | Example | 1.00 | 0.50 | 0.80 | 0.30 | 0.10 | 0.0120 | 0.012 | 0.012 | — | — | — | — | — | — | — | — | — | — | — | — |
| 30 | Example | 0.90 | 0.45 | 0.90 | 0.65 | 0.08 | 0.0120 | 0.012 | 0.012 | — | — | — | — | — | — | — | — | — | — | — | — |
| 31 | Example | 0.90 | 0.45 | 0.90 | 0.65 | 0.04 | 0.0120 | 0.012 | 0.012 | — | — | — | — | — | — | — | — | — | — | — | — |
| 32 | Example | 1.00 | 0.50 | 0.80 | 0.30 | 0.03 | 0.0120 | 0.012 | 0.012 | — | — | — | — | — | — | — | — | — | — | — | — |
| 33 | Comparative Example | 1.00 | 0.50 | 0.80 | 0.30 | 0.005 | 0.0120 | 0.012 | 0.012 | — | — | — | — | — | — | — | — | — | — | — | — |
| 34 | Comparative Example | 1.00 | 0.50 | 0.80 | 0.30 | 0.05 | 0.0250 | 0.012 | 0.012 | — | — | — | — | — | — | — | — | — | — | — | — |
| 35 | Example | 1.00 | 0.50 | 0.80 | 0.30 | 0.05 | 0.0200 | 0.012 | 0.012 | — | — | — | — | — | — | — | — | — | — | — | — |
| 36 | Example | 0.95 | 0.50 | 0.60 | 0.50 | 0.05 | 0.0120 | 0.012 | 0.012 | — | — | — | — | — | — | — | — | — | — | — | — |
| 37 | Example | 0.95 | 0.50 | 0.60 | 0.50 | 0.05 | 0.0080 | 0.012 | 0.012 | — | — | — | — | — | — | — | — | — | — | — | — |
| 38 | Example | 0.95 | 0.50 | 0.60 | 0.50 | 0.05 | 0.0050 | 0.012 | 0.012 | — | — | — | — | — | — | — | — | — | — | — | — |
| 39 | Example | 0.95 | 0.50 | 0.60 | 0.50 | 0.05 | 0.0040 | 0.012 | 0.012 | — | — | — | — | — | — | — | — | — | — | — | — |
| 40 | Example | 1.00 | 0.50 | 0.80 | 0.30 | 0.05 | 0.0030 | 0.012 | 0.012 | — | — | — | — | — | — | — | — | — | — | — | — |
| 41 | Comparative Example | 1.00 | 0.50 | 0.80 | 0.30 | 0.05 | 0.0020 | 0.012 | 0.012 | — | — | — | — | — | — | — | — | — | — | — | — |
| 42 | Comparative Example | 1.00 | 0.50 | 0.80 | 0.30 | 0.05 | 0.0120 | 0.035 | 0.012 | — | — | — | — | — | — | — | — | — | — | — | — |
| 43 | Example | 1.00 | 0.50 | 0.80 | 0.30 | 0.05 | 0.0120 | 0.025 | 0.012 | — | — | — | — | — | — | — | — | — | — | — | — |

TABLE 2-3

| | | C | Si | Mn | Cr | V | N | P | S | Mo | Co | B | Cu | Ni | Nb | Ti | Mg | Ca | REM | Zr | Al |
|---|---|---|---|---|---|---|---|---|---|---|---|---|---|---|---|---|---|---|---|---|---|
| 44 | Example | 1.00 | 0.50 | 0.80 | 0.30 | 0.05 | 0.0120 | 0.018 | 0.012 | — | — | — | — | — | — | — | — | — | — | — | — |
| 45 | Comparative Example | 1.00 | 0.50 | 0.80 | 0.30 | 0.05 | 0.0120 | 0.012 | 0.040 | — | — | — | — | — | — | — | — | — | — | — | — |

TABLE 2-3-continued

| | C | Si | Mn | Cr | V | N | P | S | Mo | Co | B | Cu | Ni | Nb | Ti | Mg | Ca | REM | Zr | Al |
|---|---|---|---|---|---|---|---|---|---|---|---|---|---|---|---|---|---|---|---|---|
| 46 Example | 1.00 | 0.50 | 0.80 | 0.30 | 0.05 | 0.0120 | 0.012 | 0.025 | — | — | — | — | — | — | — | — | — | — | — | — |
| 47 Example | 1.00 | 0.50 | 0.80 | 0.30 | 0.05 | 0.0120 | 0.012 | 0.015 | — | — | — | — | — | — | — | — | — | — | — | — |
| 48 Example | 1.00 | 0.50 | 0.80 | 0.30 | 0.05 | 0.0120 | 0.012 | 0.012 | — | — | — | — | — | — | — | — | — | — | — | — |
| 49 Comparative Example | 1.00 | 0.50 | 0.80 | 0.30 | 0.05 | 0.0120 | 0.012 | 0.012 | — | — | — | — | — | — | — | — | — | — | — | — |
| 50 Comparative Example | 1.00 | 0.50 | 0.80 | 0.30 | 0.05 | 0.0120 | 0.012 | 0.012 | — | — | — | — | — | — | — | — | — | — | — | — |
| 51 Example | 1.00 | 0.50 | 0.80 | 0.30 | 0.05 | 0.0120 | 0.012 | 0.012 | — | — | — | — | — | — | — | — | — | — | — | — |
| 52 Example | 1.00 | 0.50 | 0.80 | 0.30 | 0.05 | 0.0120 | 0.012 | 0.012 | — | — | — | — | — | — | — | — | — | — | — | — |
| 53 Comparative Example | 1.00 | 0.50 | 0.80 | 0.30 | 0.05 | 0.0120 | 0.012 | 0.012 | — | — | — | — | — | — | — | — | — | — | — | — |
| 54 Comparative Example | 1.00 | 0.50 | 0.80 | 0.30 | 0.05 | 0.0120 | 0.012 | 0.012 | — | — | — | — | — | — | — | — | — | — | — | — |
| 55 Example | 1.00 | 0.50 | 0.80 | 0.30 | 0.05 | 0.0120 | 0.012 | 0.012 | — | — | — | — | — | — | — | — | — | — | — | — |
| 56 Example | 1.00 | 0.50 | 0.80 | 0.30 | 0.05 | 0.0120 | 0.012 | 0.012 | — | — | — | — | — | — | — | — | — | — | — | — |
| 57 Comparative Example | 1.00 | 0.50 | 0.80 | 0.30 | 0.05 | 0.0120 | 0.012 | 0.012 | — | — | — | — | — | — | — | — | — | — | — | — |
| 58 Comparative Example | 1.00 | 0.50 | 0.80 | 0.30 | 0.05 | 0.0120 | 0.012 | 0.012 | — | — | — | — | — | — | — | — | — | — | — | — |
| 59 Comparative Example | 1.00 | 0.50 | 0.80 | 0.30 | 0.05 | 0.0120 | 0.012 | 0.012 | — | — | — | — | — | — | — | — | — | — | — | — |
| 60 Comparative Example | 1.00 | 0.50 | 0.80 | 0.30 | 0.05 | 0.0120 | 0.012 | 0.012 | — | — | — | — | — | — | — | — | — | — | — | — |
| 61 Comparative Example | 1.00 | 0.50 | 0.80 | 0.30 | 0.05 | 0.0120 | 0.012 | 0.012 | — | — | — | — | — | — | — | — | — | — | — | — |
| 62 Example | 1.00 | 0.50 | 0.80 | 0.30 | 0.05 | 0.0120 | 0.012 | 0.012 | — | — | — | — | — | — | — | — | — | — | — | — |

TABLE 2-4

| | C | Si | Mn | Cr | V | N | P | S | Mo | Co | B |
|---|---|---|---|---|---|---|---|---|---|---|---|
| 62 Example | 1.00 | 0.50 | 0.80 | 0.30 | 0.05 | 0.0120 | 0.012 | 0.012 | — | — | — |
| 63 Example | 1.00 | 0.50 | 0.80 | 0.30 | 0.05 | 0.0120 | 0.012 | 0.012 | — | — | — |
| 64 Example | 1.00 | 0.50 | 0.80 | 0.30 | 0.05 | 0.0120 | 0.012 | 0.012 | — | — | — |
| 65 Example | 0.80 | 0.60 | 0.65 | 0.45 | 0.05 | 0.0150 | 0.012 | 0.012 | — | — | — |
| 66 Example | 1.10 | 0.50 | 0.80 | 0.65 | 0.08 | 0.0080 | 0.012 | 0.012 | — | — | — |
| 67 Example | 1.00 | 0.50 | 0.80 | 0.30 | 0.05 | 0.0120 | 0.012 | 0.012 | 0.50 | — | — |
| 68 Example | 1.00 | 0.50 | 0.80 | 0.30 | 0.05 | 0.0120 | 0.012 | 0.012 | — | 1.00 | — |
| 69 Example | 1.00 | 0.50 | 0.80 | 0.30 | 0.05 | 0.0120 | 0.012 | 0.012 | — | — | 0.005 |
| 70 Example | 1.00 | 0.50 | 0.80 | 0.30 | 0.05 | 0.0120 | 0.012 | 0.012 | — | — | — |
| 71 Example | 1.00 | 0.50 | 0.80 | 0.30 | 0.05 | 0.0120 | 0.012 | 0.012 | — | — | — |
| 72 Example | 1.00 | 0.50 | 0.80 | 0.30 | 0.05 | 0.0120 | 0.012 | 0.012 | — | — | — |
| 73 Example | 1.00 | 0.50 | 0.80 | 0.30 | 0.05 | 0.0120 | 0.012 | 0.012 | — | — | — |
| 74 Example | 1.00 | 0.50 | 0.80 | 0.30 | 0.05 | 0.0120 | 0.012 | 0.012 | — | — | — |
| 75 Example | 1.00 | 0.50 | 0.80 | 0.30 | 0.05 | 0.0120 | 0.012 | 0.012 | — | — | — |
| 76 Example | 1.00 | 0.50 | 0.80 | 0.30 | 0.05 | 0.0120 | 0.012 | 0.012 | — | — | — |
| 77 Example | 1.00 | 0.50 | 0.80 | 0.30 | 0.05 | 0.0120 | 0.012 | 0.012 | — | — | — |
| 78 Example | 1.00 | 0.50 | 0.80 | 0.30 | 0.05 | 0.0120 | 0.012 | 0.012 | — | — | — |
| 79 Example | 1.00 | 0.50 | 0.80 | 0.30 | 0.05 | 0.0120 | 0.012 | 0.012 | — | — | — |
| 80 Example | 1.00 | 0.50 | 0.80 | 0.30 | 0.05 | 0.0120 | 0.012 | 0.012 | — | — | — |
| 81 Example | 1.00 | 0.50 | 0.80 | 0.30 | 0.05 | 0.0120 | 0.012 | 0.012 | — | — | — |
| 82 Example | 1.00 | 0.50 | 0.80 | 0.30 | 0.05 | 0.0120 | 0.012 | 0.012 | — | — | — |
| 83 Example | 1.00 | 0.50 | 0.80 | 0.30 | 0.05 | 0.0120 | 0.012 | 0.012 | — | — | — |

| | Cu | Ni | Nb | Ti | Mg | Ca | REM | Zr | Al |
|---|---|---|---|---|---|---|---|---|---|
| 62 Example | — | — | — | — | — | — | — | — | — |
| 63 Example | — | — | — | — | — | — | — | — | — |
| 64 Example | — | — | — | — | — | — | — | — | — |
| 65 Example | — | — | — | — | — | — | — | — | — |
| 66 Example | — | — | — | — | — | — | — | — | — |
| 67 Example | — | — | — | — | — | — | — | — | — |
| 68 Example | — | — | — | — | — | — | — | — | — |
| 69 Example | — | — | — | — | — | — | — | — | — |
| 70 Example | 1.00 | — | — | — | — | — | — | — | — |
| 71 Example | | 1.00 | — | — | — | — | — | — | — |
| 72 Example | — | — | 0.05 | — | — | — | — | — | — |
| 73 Example | — | — | — | 0.05 | — | — | — | — | — |
| 74 Example | — | — | — | — | 0.0200 | — | — | — | — |
| 75 Example | — | — | — | — | — | 0.0200 | — | — | — |
| 76 Example | — | — | — | — | — | — | 0.0500 | — | — |
| 77 Example | — | — | — | — | — | — | — | 0.020 | — |
| 78 Example | — | — | — | — | — | — | — | — | 1.00 |
| 79 Example | — | — | — | — | — | — | — | — | — |

TABLE 2-4-continued

| | | | | | | | | | | |
|---|---|---|---|---|---|---|---|---|---|---|
| 80 | Example | — | — | — | — | — | — | — | — | — |
| 81 | Example | — | — | — | — | — | — | — | — | — |
| 82 | Example | — | — | — | — | — | — | — | — | — |
| 83 | Example | — | — | — | — | — | — | — | — | — |

TABLE 3-1

| | | Surface pearlite area ratio (area %) | 25 mm position pearlite area ratio (area %) | Surface hardness (Hv) | 25 mm position hardness (Hv) | Number density of Cr—Containing V Nitride ($\times 10^{-17}$ $cm^{-3}$) | CA/VA | Remarks | Internal fatigue damage resistance | wear resistance |
|---|---|---|---|---|---|---|---|---|---|---|
| 1 | Example | 99 | 98 | 450 | 400 | 3.0 | 0.50 | | B | B |
| 2 | Comparative Example | 94 | 93 | 450 | 400 | 3.0 | 0.50 | pro-eutectoid cementite was formed | X | A |
| 3 | Example | 99 | 98 | 450 | 450 | 3.0 | 0.50 | | C | A |
| 4 | Example | 98 | 98 | 440 | 390 | 3.0 | 0.55 | | B | B |
| 5 | Example | 98 | 98 | 420 | 380 | 3.0 | 0.55 | | C | C |
| 6 | Example | 99 | 99 | 400 | 370 | 3.0 | 0.50 | | C | C |
| 7 | Comparative Example | 90 | 92 | 330 | 310 | 3.0 | 0.50 | pro-eutectoid ferrite was formed | X | C |
| 8 | Comparative Example | 75 | 80 | 565 | 400 | 3.0 | 0.50 | martensite was formed | B | X |
| 9 | Example | 99 | 99 | 475 | 420 | 3.0 | 0.50 | | C | C |
| 10 | Example | 99 | 99 | 460 | 410 | 3.0 | 0.60 | | B | A |
| 11 | Example | 99 | 98 | 435 | 400 | 3.0 | 0.60 | | B | A |
| 12 | Example | 99 | 98 | 380 | 370 | 3.0 | 0.50 | | C | C |
| 13 | Comparative Example | 99 | 99 | 340 | 320 | 3.0 | 0.50 | | B | X |
| 14 | Comparative Example | 80 | 85 | 550 | 450 | 3.0 | 0.50 | martensite was formed | X | X |
| 15 | Example | 99 | 99 | 460 | 415 | 3.0 | 0.50 | | C | C |
| 16 | Example | 99 | 98 | 460 | 420 | 3.0 | 0.50 | | B | B |
| 17 | Example | 99 | 99 | 425 | 390 | 3.0 | 0.50 | | B | B |
| 18 | Example | 99 | 99 | 400 | 385 | 3.0 | 0.50 | | C | C |
| 19 | Comparative Example | 90 | 92 | 340 | 330 | 3.0 | 0.50 | pro-eutectoid ferrite was formed | X | X |
| 20 | Comparative Example | 75 | 80 | 600 | 490 | 5.5 | 0.65 | martensite was formed | X | X |
| 21 | Example | 99 | 99 | 470 | 430 | 4.0 | 0.60 | | C | C |

TABLE 3-2

| | | Surface pearlite area ratio (area %) | 25 mm position pearlite area ratio (area %) | Surface hardness (Hv) | 25 mm position hardness (Hv) | Number density of Cr—Containing V Nitride ($\times 10^{-17}$ $cm^{-3}$) | CA/VA | Remarks | Internal fatigue damage resistance | wear resistance |
|---|---|---|---|---|---|---|---|---|---|---|
| 22 | Example | 99 | 98 | 450 | 420 | 3.5 | 0.55 | | B | C |
| 23 | Example | 99 | 99 | 420 | 380 | 3.0 | 0.40 | | C | C |
| 24 | Example | 99 | 98 | 390 | 360 | 2.0 | 0.25 | | C | C |
| 25 | Comparative Example | 99 | 99 | 330 | 310 | 0.5 | 0.10 | the pearlite structure was softened + constriction of precipitation little softening was insufficient | X | X |
| 26 | Comparative Example | 99 | 99 | 480 | 430 | 7.0 | 0.05 | pearlite structure was embrittled | X | B |
| 27 | Example | 99 | 98 | 475 | 450 | 4.0 | 0.07 | | C | B |
| 28 | Example | 99 | 98 | 470 | 440 | 3.9 | 0.08 | | C | B |
| 29 | Example | 99 | 98 | 465 | 435 | 3.8 | 0.10 | | B | B |
| 30 | Example | 99 | 98 | 460 | 430 | 3.5 | 0.20 | | A | C |
| 31 | Example | 99 | 99 | 420 | 380 | 2.0 | 0.45 | | B | C |
| 32 | Example | 99 | 98 | 390 | 370 | 1.5 | 0.65 | | C | B |
| 33 | Comparative Example | 99 | 99 | 380 | 365 | 0.7 | 0.70 | constriction of precipitation little softening was insufficient | X | B |
| 34 | Comparative Example | 99 | 98 | 480 | 430 | 6.0 | 0.50 | pearlite structure was embrittled | X | A |
| 35 | Example | 99 | 98 | 460 | 425 | 4.5 | 0.50 | | C | B |
| 36 | Example | 99 | 99 | 440 | 400 | 3.0 | 0.50 | | B | B |

TABLE 3-2-continued

| | | Surface pearlite area ratio (area %) | 25 mm position pearlite area ratio (area %) | Surface hardness (Hv) | 25 mm position hardness (Hv) | Number density of Cr—Containing V Nitride ($\times 10^{-17}$ $cm^{-3}$) | CA/VA | Remarks | Internal fatigue damage resistance | wear resistance |
|---|---|---|---|---|---|---|---|---|---|---|
| 37 | Example | 99 | 98 | 425 | 440 | 2.0 | 0.50 | | B | B |
| 38 | Example | 99 | 98 | 420 | 400 | 1.8 | 0.50 | | C | 8 |
| 39 | Example | 99 | 98 | 410 | 380 | 1.7 | 0.50 | | C | B |
| 40 | Example | 99 | 99 | 410 | 375 | 1.5 | 0.50 | | C | B |
| 41 | Comparative Example | 99 | 99 | 400 | 385 | 0.2 | 0.50 | constriction of precipitation little softening was insufficient | X | B |
| 42 | Comparative Example | 99 | 98 | 450 | 410 | 3.0 | 0.50 | pearlite structure was embrittled | X | B |
| 43 | Example | 99 | 99 | 450 | 410 | 3.0 | 0.50 | | C | B |

TABLE 3-3

| | | Surface pearlite area ratio (area %) | 25 mm position pearlite area ratio (area %) | Surface hardness (Hv) | 25 mm position hardness (Hv) | Number density of Cr—Containing V Nitride ($\times 10^{-17}$ $cm^{-3}$) | CA/VA | Remarks | Internal fatigue damage resistance | wear resistance |
|---|---|---|---|---|---|---|---|---|---|---|
| 44 | Example | 99 | 99 | 450 | 410 | 3.0 | 0.50 | | B | B |
| 45 | Comparative Example | 99 | 99 | 450 | 410 | 3.0 | 0.50 | MnS was coarsened | X | B |
| 46 | Example | 99 | 98 | 450 | 410 | 3.0 | 0.50 | | C | B |
| 47 | Example | 99 | 99 | 450 | 410 | 3.0 | 0.50 | | B | B |
| 48 | Example | 95 | 95 | 450 | 415 | 3.0 | 0.50 | | C | C |
| 49 | Comparative Example | 70 | 72 | 380 | 375 | 3.0 | 0.50 | bainite was formed (accelerated cooling stop temperature: 560° C.) | X | X |
| 50 | Comparative Example | 99 | 99 | 520 | 470 | 3.0 | 0.50 | the hardness of the pearlite structure was excessively high (the accelerated cooling rate was fast: 35.0° C./sec) | X | B |
| 51 | Example | 99 | 98 | 500 | 480 | 3.0 | 0.50 | | C | B |
| 52 | Example | 99 | 98 | 360 | 360 | 3.0 | 0.50 | | C | C |
| 53 | Comparative Example | 99 | 99 | 320 | 310 | 3.0 | 0.50 | the hardness of the pearlite structure was low (the accelerated cooling rate was slow: 1.0° C./sec) | X | X |
| 54 | Comparative Example | 99 | 98 | 470 | 430 | 8.0 | 0.50 | the accelerated cooling stop temperature was high (stop temperature: 680° C.) ⇒precipitate was excessively formed⇒the pearlite structure was embrittled | X | B |
| 55 | Example | 99 | 99 | 460 | 410 | 5.0 | 0.50 | | C | B |
| 56 | Example | 99 | 99 | 400 | 375 | 1.0 | 0.50 | | C | B |
| 57 | Comparative Example | 99 | 99 | 370 | 370 | 0.6 | 0.50 | coarsened grain was remained ⇒constriction of precipitation little softening was insufficient ⇒the pearlite structure was softened (heating at 10° C./min in a range of 1000° C. to 1100° C.) | X | B |
| 58 | Comparative Example | 99 | 98 | 380 | 375 | 0.7 | 0.50 | coarsened grain was remained ⇒constriction of precipitation little softening was insufficient ⇒the pearlite structure was softened (heating at 12° C./min in a range of 1100° C. to 1200° C.) | X | B |
| 59 | Comparative Example | 99 | 98 | 390 | 385 | 0.8 | 0.50 | coarsened grain was remained ⇒constriction of precipitation little softening was insufficient =>the pearlite structure was softened(heating at 0.5° C./min in a range of 1000° C. to 1100° C.) | X | B |

TABLE 3-3-continued

| | | Surface pearlite area ratio (area %) | 25 mm position pearlite area ratio (area %) | Surface hardness (Hv) | 25 mm position hardness (Hv) | Number density of Cr—Containing V Nitride ($\times 10^{-17}$ cm$^{-3}$) | CA/VA | Remarks | Internal fatigue damage resistance | wear resistance |
|---|---|---|---|---|---|---|---|---|---|---|
| 60 | Comparative Example | 99 | 99 | 395 | 390 | 0.9 | 0.50 | coarsened grain was remained ⇒constriction of precipitation little softening was insufficient ⇒the pearlite structure was softened (heating at 0.8° C./min in a range of 1100° C. to 1200° C.) | X | B |
| 61 | Comparative Example | 99 | 99 | 385 | 380 | 0.5 | 0.50 | coarsened grain was remained ⇒constriction of precipitation little softening was insufficient ⇒the pearlite structure was softened (heating at 10.0° C./min in a range of 1000° C. to 1200° C.) | X | B |

20

TABLE 3-4

| | | Surface pearlite area ratio (area %) | 25 mm position pearlite area ratio (area %) | Surface hardness (Hv) | 25 mm position hardness (Hv) | Number density of Cr—Containing V Nitride ($\times 10^{-17}$ cm$^{-3}$) | CA/VA | Remarks | Internal fatigue damage resistance | wear resistance |
|---|---|---|---|---|---|---|---|---|---|---|
| 62 | Example | 99 | 99 | 470 | 420 | 3.0 | 0.70 | | A | B |
| 63 | Example | 99 | 99 | 470 | 420 | 3.0 | 0.80 | CA/VA was high, internal fatigue damage resistance was slightly reduced | B | B |
| 64 | Example | 99 | 98 | 470 | 420 | 3.0 | 1.00 | CA/VA was high, internal fatigue damage resistance was slightly reduced | C | B |
| 65 | Example | 99 | 99 | 415 | 385 | 3.5 | 1.20 | CA/VA was high, internal fatigue damage resistance was slightly reduced | C | C |
| 66 | Example | 99 | 99 | 475 | 430 | 4.0 | 0.95 | CA/VA was high, internal fatigue damage resistance was slightly reduced | C | A |
| 67 | Example | 99 | 99 | 470 | 430 | 3.0 | 0.50 | | A | A |
| 68 | Example | 99 | 98 | 470 | 430 | 3.0 | 0.50 | | A | A |
| 69 | Example | 99 | 99 | 470 | 430 | 3.0 | 0.50 | | A | B |
| 70 | Example | 99 | 99 | 470 | 430 | 3.0 | 0.50 | | A | A |
| 71 | Example | 99 | 99 | 470 | 430 | 3.0 | 0.50 | | A | A |
| 72 | Example | 99 | 98 | 470 | 430 | 3.0 | 0.50 | | A | A |
| 73 | Example | 99 | 99 | 470 | 430 | 3.0 | 0.50 | | A | A |
| 74 | Example | 99 | 99 | 470 | 430 | 3.0 | 0.50 | | A | B |
| 75 | Example | 99 | 99 | 470 | 430 | 3.0 | 0.50 | | A | B |
| 76 | Example | 99 | 98 | 470 | 430 | 3.0 | 0.50 | | A | B |
| 77 | Example | 99 | 99 | 470 | 430 | 3.0 | 0.50 | | A | B |
| 78 | Example | 99 | 99 | 470 | 430 | 3.0 | 0.50 | | A | A |
| 79 | Example | 99 | 99 | 470 | 380 | 1.5 | 0.50 | heating at 8.0° C./min in a range of 1000° C. to 1200° C. | C | A |
| 80 | Example | 99 | 99 | 470 | 400 | 2.0 | 0.50 | heating at 6.0° C./min in a range of 1000° C. to 1200° C. | B | A |
| 81 | Example | 99 | 99 | 470 | 420 | 2.5 | 0.50 | heating at 5.0° C./min in a range of 1000° C. to 1200° C. | A | A |
| 82 | Example | 99 | 99 | 470 | 420 | 2.5 | 0.50 | heating at 3.0° C./min in a range of 1000° C. to 1200° C. | A | A |
| 83 | Example | 99 | 99 | 470 | 400 | 2.0 | 0.50 | heating at 2.0° C./min in a range of 1000° C. to 1200° C. | B | A |

As shown in the tables, in the rail in which the chemical composition, the area ratio of the pearlite structure, the hardness, and the number density of the V nitride including Cr were in the ranges of the present invention, the wear resistance and the internal fatigue damage resistance were excellent. In addition, in the rail in which CA/VA was in the range of the present invention, the wear resistance and the internal fatigue damage resistance were higher.

On the other hand, in the rail according to Comparative Examples in which one or more among the chemical composition, the area ratio of the pearlite structure, the hardness, and the number density of the V nitride including Cr was outside of the ranges of the present invention, either or both of the wear resistance and the internal fatigue damage resistance were poor.

In No. 2, the internal fatigue damage resistance deteriorated. The reason for this is presumed to be that, since the C content was excessively great, a large amount of pro-eutectoid cementite was formed such that the amount of the pearlite structure was insufficient.

In No. 7, the internal fatigue damage resistance deteriorated. The reason for this is presumed to be that, since the C content was insufficient, a large amount of pro-eutectoid ferrite was formed such that the amount and the hardness of the pearlite structure were insufficient.

In No. 8, the wear resistance deteriorated. The reason for this is presumed to be that, since the Si content was excessively great, a large amount of martensite was formed such that the amount of the pearlite structure was insufficient, and the hardness was excessively high. Martensite has high hardness but low wear resistance. Therefore, martensite does not contribute to the wear resistance of No. 8.

In No. 13, the wear resistance deteriorated. The reason for this is presumed to be that, since the Si content was insufficient, the hardness was insufficient.

In No. 14, the internal fatigue damage resistance and the wear resistance deteriorated. The reason for this is presumed to be that, since the Mn content was excessively great, a large amount of martensite was formed such that the amount of the pearlite structure was insufficient, and the hardness was excessively high.

In No. 19, the internal fatigue damage resistance and the wear resistance deteriorated. The reason for this is presumed to be that, since the Mn content was insufficient, a large amount of pro-eutectoid ferrite was formed such that the amount and the hardness of the pearlite structure were insufficient.

In No. 20, the internal fatigue damage resistance and the wear resistance deteriorated. The reason for this is presumed to be that, since the Cr content was excessively great, a large amount of martensite was formed such that the amount of the pearlite structure was insufficient, the hardness was excessively high, and the number density of the V nitride including Cr was excessively high.

In No. 25, the internal fatigue damage resistance and the wear resistance deteriorated. The reason for this is presumed to be that, since the pearlite structure was softened and the number density of the V nitride including Cr was insufficient due to an insufficient amount of Cr, local softening of ferrite in the pearlite structure was not suppressed.

In No. 26, the internal fatigue damage resistance deteriorated. The reason for this is presumed to be that, since the V content was excessively great, the number density of the V nitride including Cr was excessively great, and the pearlite structure was embrittled.

In No. 33, the internal fatigue damage resistance deteriorated. The reason for this is presumed to be that, since the number density of the V nitride including Cr was insufficient due to an insufficient amount of V, local softening of ferrite in the pearlite structure was not suppressed.

In No. 34, the internal fatigue damage resistance deteriorated. The reason for this is presumed to be that, since the N content was excessively great, the number density of the V nitride including Cr was excessively great, and the pearlite structure was embrittled.

In No. 41, the internal fatigue damage resistance deteriorated. The reason for this is presumed to be that, since the number density of the V nitride including Cr was insufficient due to an insufficient amount of N, local softening of ferrite in the pearlite structure was not suppressed.

In No. 42, the internal fatigue damage resistance deteriorated. The reason for this is presumed to be that, since the P content was excessively great, the pearlite structure was embrittled.

In No. 45, the internal fatigue damage resistance deteriorated. The reason for this is presumed to be that, since the S content was excessively great, a large number of coarse MnS were formed.

In No. 49, the internal fatigue damage resistance and the wear resistance deteriorated. The reason for this is presumed to be that, since the accelerated cooling stop temperature was excessively low, bainite was formed, and the pearlite structure was insufficient.

In No. 50, the internal fatigue damage resistance deteriorated. The reason for this is presumed to be that, since the accelerated cooling rate was excessively fast, the hardness of the pearlite structure was excessively high.

In No. 53, the internal fatigue damage resistance and the wear resistance deteriorated. The reason for this is presumed to be that, since the accelerated cooling rate was excessively slow, the hardness of the pearlite structure was insufficient.

In No. 54, the internal fatigue damage resistance deteriorated. The reason for this is presumed to be that, since the accelerated cooling stop temperature was excessively high, the V nitride including Cr was excessively formed, and the pearlite structure was embrittled.

In No. 57, the internal fatigue damage resistance deteriorated. The reason for this is presumed to be that, since there was a period where the heating rate during heating of the bloom was fast, the V nitride including Cr coarsened during casting remained, the number density of the V nitride including Cr was insufficient, and local softening of ferrite in the pearlite structure was not suppressed.

In No. 58, the internal fatigue damage resistance deteriorated. The reason for this is presumed to be that, since there was a period where the heating rate during heating of the bloom was fast, the V nitride including Cr coarsened during casting remained, the number density of the V nitride including Cr was insufficient, and local softening of ferrite in the pearlite structure was not suppressed.

In No. 59, the internal fatigue damage resistance deteriorated. The reason for this is presumed to be that, since there was a period where the heating rate during heating of the bloom was slow, the V nitride including Cr was temporarily dissolved, reprecipitated, and coarsened during heating, the number density of the V nitride including Cr was insufficient, and local softening of ferrite in the pearlite structure was not suppressed.

In No. 60, the internal fatigue damage resistance deteriorated. The reason for this is presumed to be that, since there was a period where the heating rate during heating of the bloom was slow, the V nitride including Cr was temporarily dissolved, reprecipitated, and coarsened during heating, the number density of the V nitride including Cr was insufficient, and local softening of ferrite in the pearlite structure was not suppressed.

In No. 61, the internal fatigue damage resistance deteriorated. The reason for this is presumed to be that, since there was a period where the heating rate during heating of the bloom was fast, the V nitride including Cr coarsened during casting remained, the number density of the V nitride including Cr was insufficient, and local softening of ferrite in the pearlite structure was not suppressed.

INDUSTRIAL APPLICABILITY

According to the present invention, the wear resistance and the internal fatigue damage resistance of the rail can be improved. Accordingly, according to the present invention, for example, the service life of the rail used in cargo railways can be significantly improved.

BRIEF DESCRIPTION OF THE REFERENCE SYMBOLS

1: HEAD TOP PORTION
2: CORNER HEAD PORTION
3: RAIL HEAD PORTION
3*a*: HEAD SURFACE PORTION
4: SLIDER FOR MOVING RAIL
5: RAIL
6: WHEEL
7: MOTOR
8: LOADING DEVICE

What is claimed is:

1. A rail comprising, by mass %:
C: 0.75% to 1.20%;
Si: 0.10% to 2.00%;
Mn: 0.10% to 2.00%;
Cr: 0.10% to 1.20%;
V: 0.010% to 0.200%;
N: 0.0030% to 0.0200%;
P≤0.0250%;
S≤0.0250%;
Mo: 0% to 0.50%;
Co: 0% to 1.00%;
B: 0% to 0.0050%;
Cu: 0% to 1.00%;
Ni: 0% to 1.00%;
Nb: 0% to 0.0500%;
Ti: 0% to 0.0500%;
Mg: 0% to 0.0200%;
Ca: 0% to 0.0200%;
REM: 0% to 0.0500%;
Zr: 0% to 0.0200%;
Al: 0% to 1.00%; and
a remainder including Fe and impurities, wherein
a structure ranging from an outer surface of a head portion as an origin to a depth of 25 mm includes 95% or greater of a pearlite structure by area ratio,
a hardness of the structure is in a range of Hv 360 to 500, and
in ferrite of the pearlite structure at a position at the depth of 25 mm from the outer surface of the head portion as the origin, a number density of a V nitride having a grain size of 0.5 to 4.0 nm and including Cr is in a range of $1.0\times10^{17}$ to $5.0\times10^{17}$ $cm^{-3}$.

2. The rail according to claim 1,
wherein in the V nitride having the grain size of 0.5 to 4.0 nm and including Cr in the ferrite of the pearlite structure at a position at the depth of 25 mm from the outer surface of the head portion, when the number of V atoms is represented by VA and the number of Cr atoms is represented by CA, an average value of CA/VA satisfies the following Expression 1, $$0.01 \leq \text{average value of } CA/VA \leq 0.70 \qquad \text{Expression 1.}$$

3. The rail according to claim 1, comprising, by mass %, one or more groups selected from the group consisting of:
a group a: Mo: 0.01% to 0.50%;
a group b: Co: 0.01% to 1.00%;
a group c: B: 0.0001% to 0.0050%;
a group d: one or two selected from Cu: 0.01% to 1.00% and Ni: 0.01% to 1.00%;
a group e: one or more selected from Nb: 0.0010% to 0.0500% and Ti: 0.0030% to 0.0500%;
a group f: one or more selected from Mg: 0.0005% to 0.0200%, Ca: 0.0005% to 0.0200%, and REM: 0.0005% to 0.0500%;
a group g: Zr: 0.0001% to 0.0200%; and
a group h: Al: 0.0100% to 1.00%.

4. The rail according to claim 2, comprising, by mass %, one or more groups selected from the group consisting of:
a group a: Mo: 0.01% to 0.50%;
a group b: Co: 0.01% to 1.00%;
a group c: B: 0.0001% to 0.0050%;
a group d: one or two selected from Cu: 0.01% to 1.00% and Ni: 0.01% to 1.00%;
a group e: one or more selected from Nb: 0.0010% to 0.0500% and Ti: 0.0030% to 0.0500%;
a group f: one or more selected from Mg: 0.0005% to 0.0200%, Ca: 0.0005% to 0.0200%, and REM: 0.0005% to 0.0500%;
a group g: Zr: 0.0001% to 0.0200%; and
a group h: Al: 0.0100% to 1.00%.

* * * * *